US008469088B2

(12) United States Patent
Shkurti et al.

(10) Patent No.: US 8,469,088 B2
(45) Date of Patent: Jun. 25, 2013

(54) DRILLABLE BRIDGE PLUG FOR HIGH PRESSURE AND HIGH TEMPERATURE ENVIRONMENTS

(75) Inventors: Piro Shkurti, The Woodlands, TX (US); John C. Wolf, Houston, TX (US)

(73) Assignee: Smith International, Inc., Houston, TX (US)

( * ) Notice: Subject to any disclaimer, the term of this patent is extended or adjusted under 35 U.S.C. 154(b) by 369 days.

(21) Appl. No.: 12/702,066

(22) Filed: Feb. 8, 2010

(65) Prior Publication Data

US 2010/0132960 A1 Jun. 3, 2010

Related U.S. Application Data

(63) Continuation-in-part of application No. 11/967,881, filed on Dec. 31, 2007, now Pat. No. 7,810,558, which is a continuation-in-part of application No. 11/064,306, filed on Feb. 23, 2005, now Pat. No. 7,424,909.

(60) Provisional application No. 60/548,718, filed on Feb. 27, 2004.

(51) Int. Cl.
*E21B 33/12* (2006.01)
*E21B 23/00* (2006.01)

(52) U.S. Cl.
USPC ..... 166/192; 166/138

(58) Field of Classification Search
USPC ..... 166/196, 192, 118, 138
See application file for complete search history.

(56) References Cited

U.S. PATENT DOCUMENTS

| | | | |
|---|---|---|---|
| 2,155,129 | A | 4/1939 | Hall et al. |
| 2,215,913 | A | 9/1940 | Brown |
| 3,785,811 | A | 1/1974 | Pelzel |
| 3,910,348 | A | 10/1975 | Pitts |
| 4,146,093 | A | 3/1979 | Horvath et al. |
| 4,374,543 | A | 2/1983 | Richardson |
| 4,593,765 | A | 6/1986 | Greenlee |

(Continued)

FOREIGN PATENT DOCUMENTS

| | | | |
|---|---|---|---|
| JP | 11148295 | A | 6/1999 |
| SU | 926238 | A1 | 5/1982 |
| SU | 1776770 | A1 | 11/1992 |

OTHER PUBLICATIONS

U.S. Office Action for related U.S. Appl. No. 12/198,859; dated Jul. 1, 2010 (11 pages).

(Continued)

*Primary Examiner* — Shane Bomar
*Assistant Examiner* — Catherine Loikith

(57) ABSTRACT

A drillable bridge plug includes a mandrel having external splines disposed on an outer surface of the mandrel, a sealing element disposed around the mandrel, an upper cone disposed around the mandrel proximate an upper end of the sealing element, and a lower cone disposed around the mandrel proximate the lower end of the sealing element, wherein an inner surface of the lower cone comprises internal splines configured to engage the external splines. The drillable bridge plug also includes an upper and a lower slip assembly disposed around the mandrel, and an upper and lower ring assembly each including a first segmented barrier ring, a second segmented barrier ring, and a back-up ring disposed proximate sealing element. Methods include a method of setting the drillable bridge plug and a method of removing the drillable bridge plug.

24 Claims, 27 Drawing Sheets

U.S. PATENT DOCUMENTS

| | | | | |
|---|---|---|---|---|
| 4,595,052 | A | 6/1986 | Kristiansen | |
| 4,784,226 | A | 11/1988 | Wyatt | |
| 5,058,671 | A | 10/1991 | Cochran | |
| 5,224,540 | A | 7/1993 | Streich et al. | |
| 5,271,468 | A | 12/1993 | Streich et al. | |
| 5,333,685 | A | 8/1994 | Gilbert | |
| 5,511,620 | A * | 4/1996 | Baugh et al. | 166/387 |
| 5,701,959 | A | 12/1997 | Hushbeck et al. | |
| 2,165,433 | A | 6/1999 | Wickersham | |
| 6,167,963 | B1 | 1/2001 | McMahan et al. | |
| 6,491,108 | B1 * | 12/2002 | Slup et al. | 166/387 |
| 6,578,633 | B2 * | 6/2003 | Slup et al. | 166/118 |
| 6,695,050 | B2 * | 2/2004 | Winslow et al. | 166/118 |
| 6,708,768 | B2 * | 3/2004 | Slup et al. | 166/382 |
| 6,708,770 | B2 * | 3/2004 | Slup et al. | 166/387 |
| 6,796,376 | B2 | 9/2004 | Frazier | |
| 7,255,178 | B2 * | 8/2007 | Slup et al. | 166/386 |
| 7,424,909 | B2 | 9/2008 | Roberts et al. | |
| 7,600,572 | B2 * | 10/2009 | Slup et al. | 166/386 |
| 2004/0045723 | A1 | 3/2004 | Slup et al. | |
| 2004/0251025 | A1 | 12/2004 | Giroux et al. | |
| 2008/0190600 | A1 | 8/2008 | Shkurti et al. | |
| 2008/0308266 | A1 | 12/2008 | Roberts et al. | |
| 2010/0326650 | A1 | 12/2010 | Tran et al. | |

OTHER PUBLICATIONS

U.S. Office Action for related U.S. Appl. No. 11/967,881 dated Mar. 16, 2010 (6 pages).

Anonymous, RD 435124, A Removal Downhole Plug, Jul. 10, 2000.

* cited by examiner

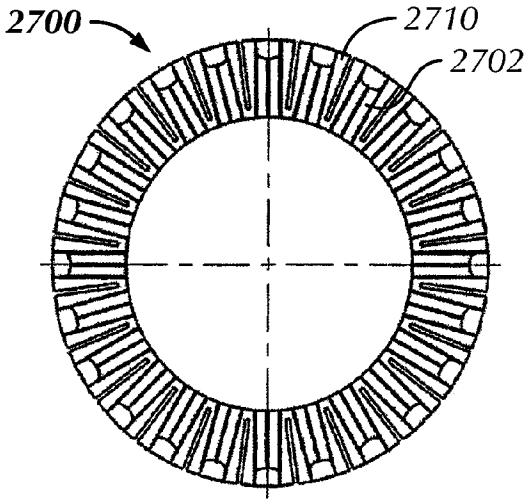
FIG. 23A
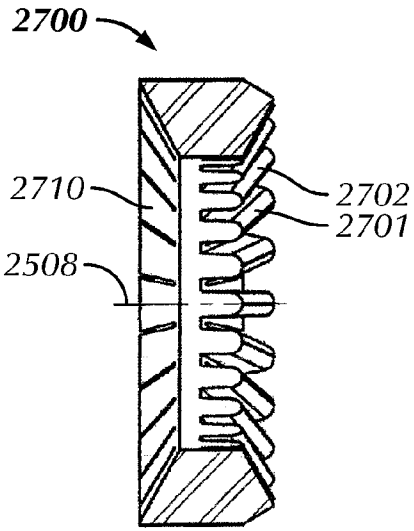
FIG. 23B
FIG. 23C

DRILLABLE BRIDGE PLUG FOR HIGH PRESSURE AND HIGH TEMPERATURE ENVIRONMENTS

CROSS-REFERENCE TO RELATED APPLICATIONS

This application claims the benefit pursuant to 35 U.S.C. §120 as a continuation-in-part application of U.S. Patent Publication No. 2008/0190600 filed Dec. 31, 2007, which claims benefit pursuant to 35 U.S.C. §120 as a continuation-in-part application of U.S. Pat. No. 7,424,909 filed Feb. 23, 2005. U.S. Pat. No. 7,424,909 claims priority under 35 U.S.C. §119 (e) from Ser. No. 60/548,718, filed on Feb. 27, 2004. The above referenced applications are hereby incorporated by reference in their entirety.

BACKGROUND OF INVENTION

1. Field of the Invention

Embodiments disclosed herein relate generally to methods and apparatus for drilling and completing well bores. More specifically, embodiments disclosed herein relate to methods and apparatus for a drillable bridge plug.

2. Background Art

In drilling, completing, or reworking wells, it often becomes necessary to isolate particular zones within the well. In some applications, downhole tools, known as temporary or permanent bridge plugs, are inserted into the well to isolate zones. The purpose of the bridge plug is to isolate some portion of the well from another portion of the well. In some instances, perforations in the well in one section need to be isolated from perforations in another section of the well. In other situations, there may be a need to use a bridge plug to isolate the bottom of the well from the wellhead.

Drillable bridge plugs generally include a mandrel, a sealing element disposed around the mandrel, a plurality of backup rings disposed around the mandrel and adjacent the sealing element, an upper slip assembly and a lower slip assembly disposed around the mandrel, and an upper cone and a lower cone disposed around the mandrel adjacent the upper and lower slip assemblies, respectively. FIG. 1 shows a section view of a well 10 with a wellbore 12 having a bridge plug 15 disposed within a wellbore casing 20. The bridge plug 15 is typically attached to a setting tool and run into the hole on wire line or tubing (not shown), and then actuated with, for example, a hydraulic system. As illustrated in FIG. 1, the wellbore is sealed above and below the bridge plug so that oil migrating into the wellbore through perforations 23 will be directed to the surface of the well.

The drillable bridge plug may be set by wireline, coil tubing, or a conventional drill string. The plug may be placed in engagement with the lower end of a setting tool that includes a latch down mechanism and a ram. The plug is then lowered through the casing to the desired depth and oriented to the desired orientation. When setting the plug, a setting tool pulls upwardly on the mandrel, thereby pushing the upper and lower cones along the mandrel. This forces the upper and lower slip assemblies, backup rings, and the sealing element radially outward, thereby engaging the segmented slip assemblies with the inside wall of the casing. It has been found that once the plug is set, the slip assemblies may not be uniformly disposed around the inside wall of the casing. This non-uniform positions of the segmented slip assemblies results in uneven stress distribution on the segmented slip assemblies and the adjacent cones. An uneven stress distribution may limit the axial load capacities of the slip assemblies and casing, and reduce the collapse strength of the adjacent cones.

Further, due to the makeup or engagement of the backup rings adjacent the sealing element sealing element, the backup rings may provide an extrusion path for the sealing element. Extrusion of the sealing element causes loosening of the seal against the casing wall, and may therefore cause the downhole tool to leak.

Additionally, it has been found that downhole tools may leak at high pressures unless they include a means for increasing the seal energization, such as a pressure responsive self-energizing feature. Leakage occurs because even when a high setting force is used to set the downhole tool seals, once the setting force is removed, the ratchet system of the lock ring will retreat slightly before being arrested by the locking effect created when the sets of ratchet teeth mate firmly at the respective bases and apexes of each. This may cause a loosening of the seal. Downhole tools are also particularly prone to leak if fluid pressures on the packers are cycled from one direction to the other.

When it is desired to remove one or more of these bridge plugs from a wellbore, it is often simpler and less expensive to mill or drill them out rather than to implement a complex retrieving operation. In milling, a milling cutter is used to grind the tool, or at least the outer components thereof, out of the well bore. In drilling, a drill bit or mill is used to cut and grind up the components of the bridge plug to remove it from the wellbore. It has been found that when drilling up a bridge plug, lower components of the bridge plug may no longer engage the mandrel. Thus, as the drill rotates to drill up the plug, the lower components spin or rotate within the well. This spinning or rotation of the lower components during drilling of the plug increases the time required to drill up the plug.

Accordingly, there exists a need for a bridge plug that effectively seals a wellbore.

Additionally, there exists a need for a bridge plug that may sustain a greater load capacity and may increase the collapse strength of components of the bridge plug. Further, a bridge plug that is easier to drill up may also be desirable.

SUMMARY OF INVENTION

In one aspect, the embodiments disclosed herein relate to a drillable bridge plug including a mandrel having an upper end and a lower end, wherein the lower end comprises external splines disposed on an outer surface of the mandrel, a sealing element disposed around the mandrel, an upper cone disposed around the mandrel proximate an upper end of the sealing element, a lower cone disposed around the mandrel proximate the lower end of the sealing element, wherein an inner surface of the lower cone comprises internal splines configured to engage the external splines, an upper slip assembly disposed around the mandrel adjacent a sloped surface of the upper cone, and a lower slip assembly disposed around the mandrel adjacent a sloped surface of the lower cone. The drillable bridge plug may further include an upper ring assembly comprising a first upper segmented barrier ring, a second upper segmented barrier ring, and an upper back-up ring disposed proximate the upper end of the sealing element, wherein a plurality of segments disposed in the first upper segmented barrier ring are radially offset with respect to a plurality of segments disposed in the second upper segmented barrier ring, a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring, and a bottom sub.

In another aspect, the embodiments disclosed herein relate to a method of setting a drillable bridge plug including applying an upward axial force to a mandrel, transferring the upward axial force to a lower cone and an upper cone, compressing a sealing element between the upper cone and the lower cone, radially expanding the sealing element into contact with a casing, creating a seal between the sealing element and the casing, deforming an upper ring assembly and a lower ring assembly radially outwardly into contact with the casing, exceeding a predetermined pressure of an upper slip assembly and a lower slip assembly, and radially expanding the upper slip assembly and the lower slip assembly to engage the casing, wherein the seal is fluid-tight under pressure up to approximately 15,000 pounds per square inch and under temperatures up to approximately 400° Fahrenheit.

In yet another aspect, the embodiments disclosed herein relate to a method of removing a drillable bridge plug including milling through a top portion of a first drillable bridge plug, the top portion of the first drillable bridge plug including a first mandrel having an upper end and a lower end, wherein the lower end comprises external splines disposed on an outer surface of the mandrel, a sealing element disposed around the mandrel, an upper cone disposed around the mandrel proximate an upper end of the sealing element, a lower cone disposed around the mandrel proximate the lower end of the sealing element, wherein an inner surface of the lower cone comprises internal splines configured to engage the external splines, an upper slip assembly disposed around the mandrel adjacent a sloped surface of the upper cone, a lower slip assembly disposed around the mandrel adjacent a sloped surface of the lower cone, an upper ring assembly comprising a first upper segmented barrier ring, a second upper segmented barrier ring, and an upper back-up ring disposed proximate the upper end of the sealing element, wherein a plurality of segments disposed in the first upper segmented barrier ring are radially offset with respect to a plurality of segments disposed in the second upper segmented barrier ring, a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring, and a bottom sub connected to the lower end of the first mandrel using a connector. The method may further include milling through the connector disposed between the lower sub and the lower end of the first mandrel, and releasing a lower portion of the lower sub such that the lower portion of the lower sub falls onto a top portion of a second drillable bridge plug, wherein the lower portion of the lower sub comprises an inner thread, and wherein the top portion of the second drillable bridge plug comprises an outer thread configured to engage the inner thread of the lower portion of the lower sub.

Other aspects and advantages of the invention will be apparent from the following description and the appended claims.

BRIEF DESCRIPTION OF DRAWINGS

FIGS. 23A, 23B, and 23C show top, side cross-sectional, and bottom views, respectively, of a component of a downhole tool in accordance with embodiments disclosed herein.

DETAILED DESCRIPTION

Figure 1:
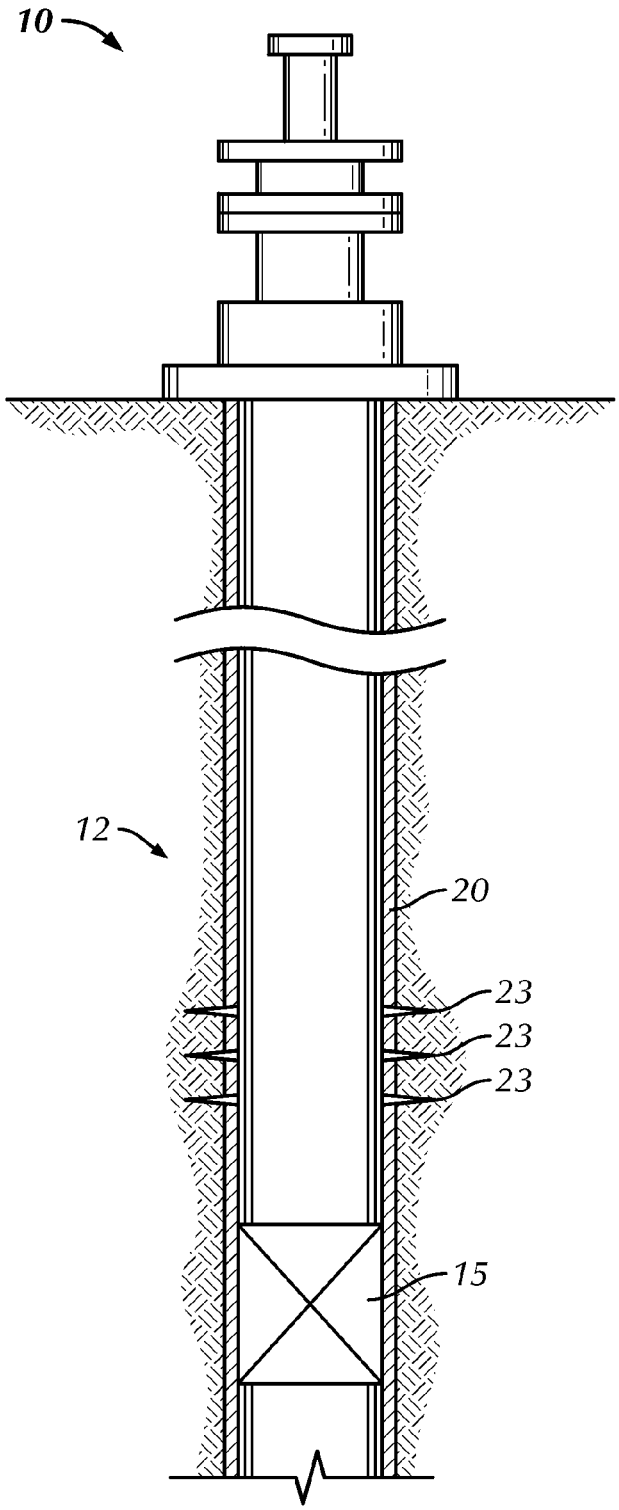
FIG. 1 shows a section view of a prior art plug assembly as set in a wellbore.

In one aspect, embodiments disclosed herein relate generally to a downhole tool for isolating zones in a well. In certain aspects, embodiments disclosed herein relate to a downhole tool for isolating zones in a well that provides efficient sealing of the well. In another aspect, embodiments disclosed herein relate to a downhole tool for isolating zones in a well that may be more quickly drilled or milled up. In certain aspects, embodiments disclosed herein relate to bridge plugs and frac plugs.

Like elements in the various figures are denoted by like reference numerals for consistency.

Figure 2A:
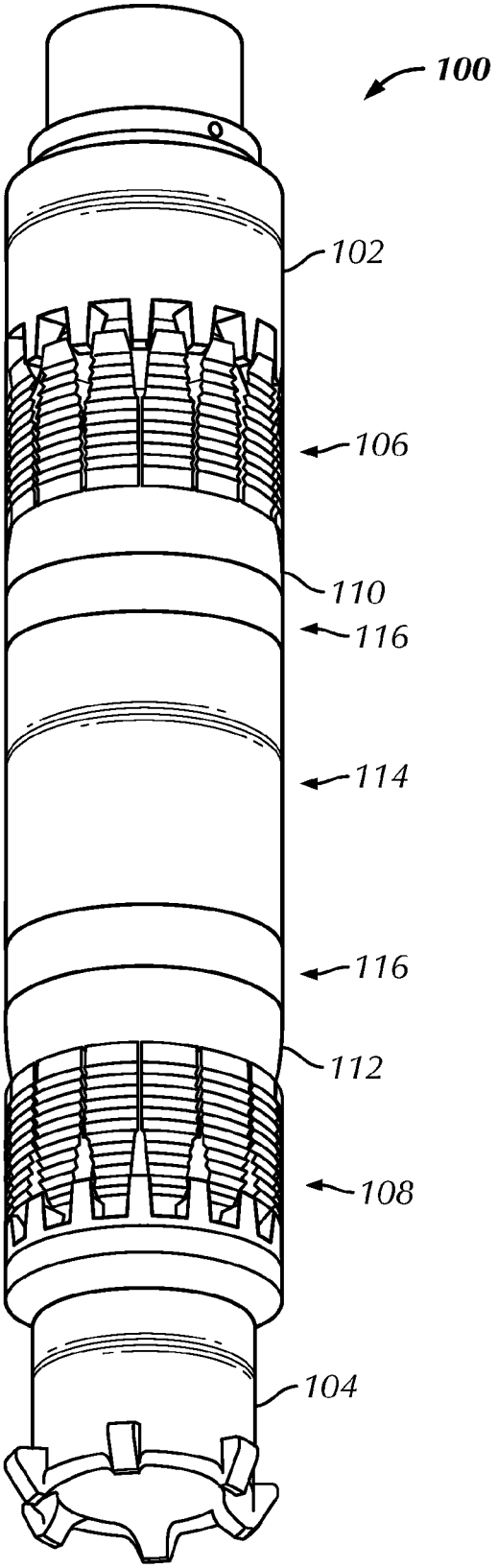
FIG. 2A is a perspective view of a bridge plug in accordance with embodiments disclosed herein.
Figure 2B:
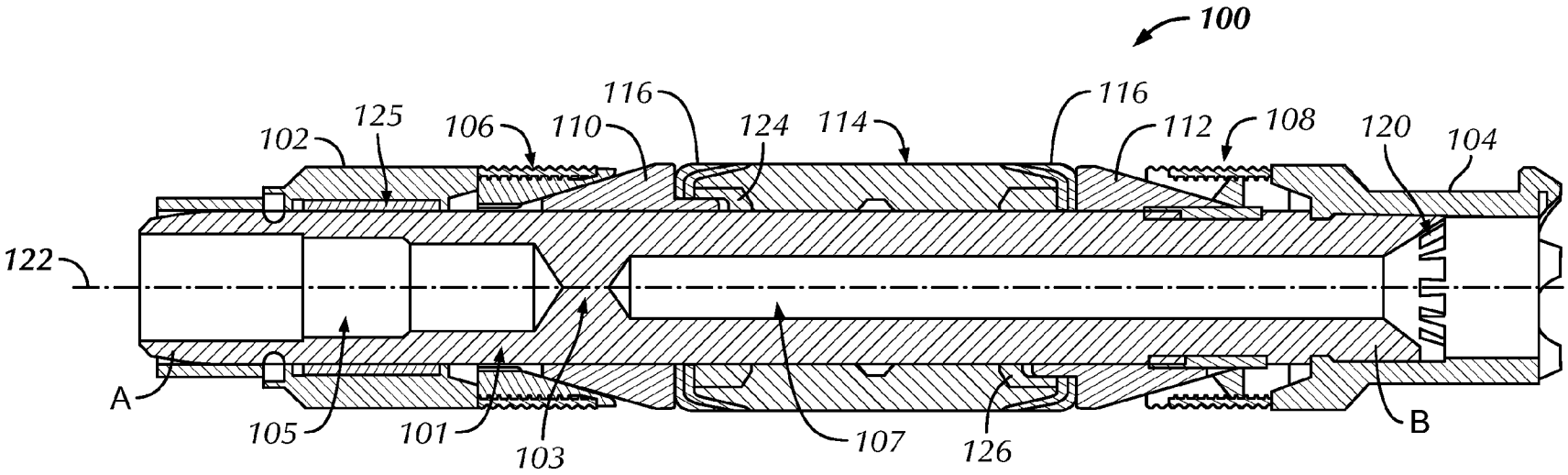
FIG. 2B is a cross-sectional view of a bridge plug in accordance with embodiments disclosed herein.

Referring now to FIGS. 2A and 2B, a bridge plug 100 in accordance with one embodiment of the present disclosure is shown in an unexpanded condition, or after having been run downhole but prior to setting it in the wellbore. The unexpanded condition is defined as the state in which the bridge plug 100 is run downhole, but before a force is applied to axially move components of the bridge plug 100 and radially expand certain components of the bridge plug 100 to engage a casing wall. As shown, bridge plug 100 includes a mandrel 101 having a central axis 122, about which other components of the bridge plug 100 are mounted. The mandrel 101 includes an upper end A and a lower end B, wherein the upper end A and lower end B of the mandrel 101 include a threaded connection (not shown), for example, a taper thread. The lower end B of the mandrel 101 also includes a plurality of tongues 120 disposed around the lower circumference of the mandrel 101.

In one embodiment, mandrel 101 includes a bridge 103 integrally formed with the mandrel 101. As shown in FIG. 2B, the bridge 103 is formed between two internal bores 105, 107 formed in the mandrel 101 and disposed proximate an upper cone 110 when the bridge plug 100 is assembled. In this embodiment, upper internal bore 105 has a diameter greater that lower internal bore 107. Pressure applied from above the bridge plug 100 provides a collapse pressure on the mandrel, whereas pressure applied from below the bridge plug 100 provides a burst pressure on the mandrel 101.

Figure 2C:
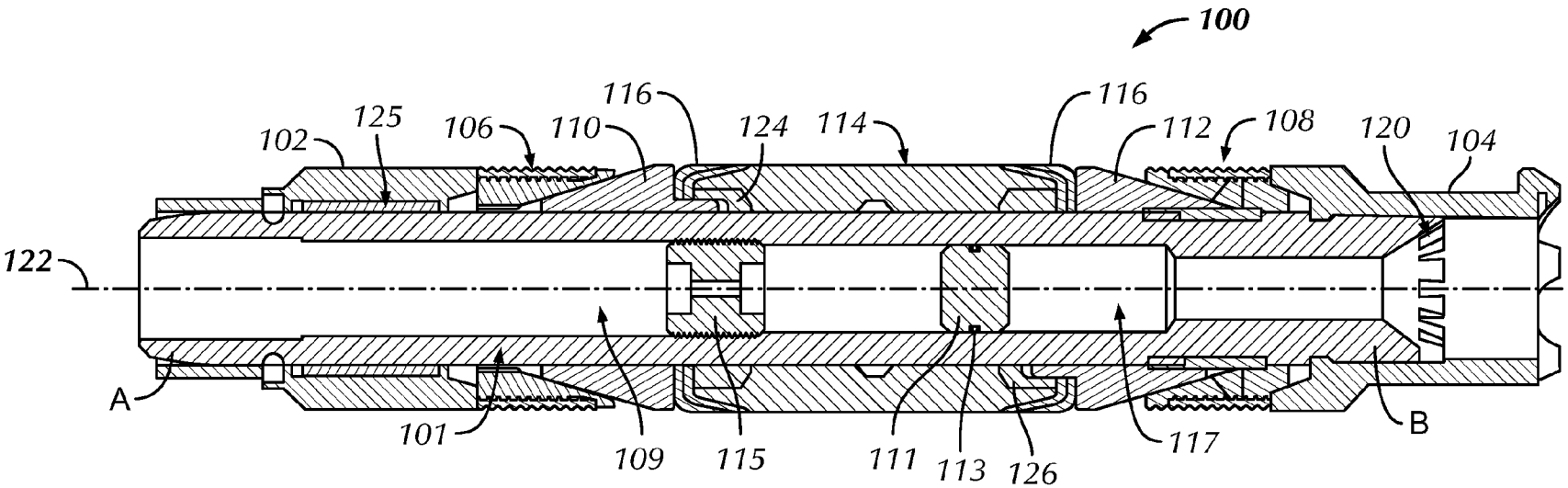
FIG. 2C is a cross-sectional view of a bridge plug in accordance with embodiments disclosed herein.

In an alternate embodiment, as shown in FIG. 2C, mandrel 101 is formed with a single bore 109 having a substantially constant diameter along the length of the mandrel 101. In this embodiment, an upper stop block 115 is disposed in the bore 109. In one embodiment, the upper stop block 115 is a solid cylindrical component sealingly engaged with an inner wall of the mandrel and disposed proximate an upper end of the sealing element 114. Alternatively, the upper stop block 115 may be a hollow cylindrical component, or a cylindrical component with a bore therethrough, sealingly engaged with the inner wall of the mandrel. A movable bridge 111 is disposed in the bore 109 below the upper stop block 115. A sealing element 113, for example, an elastomeric ring or o-ring, is disposed around the moveable bridge 111, such that the sealing element 113 and the outer surface of the moveable bridge 111 provide a seal against the inner wall of the mandrel 101. A lower stop block 117 is disposed below the moveable bridge 111. As shown, lower stop block 117 is formed by a change in the inner diameter of the mandrel 101. As such, in this embodiment, lower stop block 117 is a bearing shoulder. In alternate embodiment, upper stop block 115 may be a similar bearing shoulder, while lower stop block 117 is a solid cylindrical component or a cylindrical component with a bore therethrough, sealingly engaged with the inner wall of the mandrel.

When a pressure differential is applied to the bridge plug 100, the movable plug 111 moves upward or downward in the mandrel 101 between the upper and lower stop blocks 115, 117. Thus, the movable plug 111 acts like a piston moving within a piston housing, i.e., the mandrel 101. Movement of the movable plug 111 with respect to the applied pressure may reduce the differential pressure across the cross-section of the mandrel 101 proximate a sealing element 114 or may provide a burst pressure on the mandrel 101.

Figure 3A:
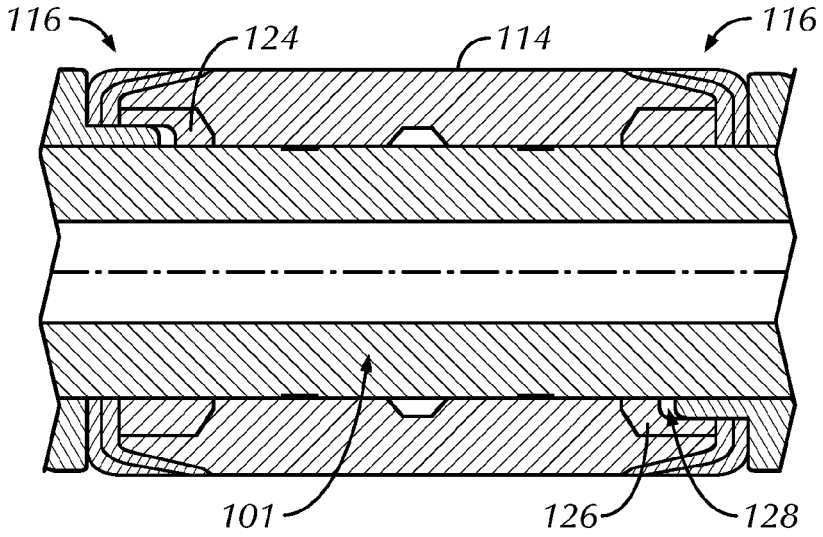
FIGS. 3A and 3B show a sealing element in accordance with embodiments disclosed herein.
Figure 3B:
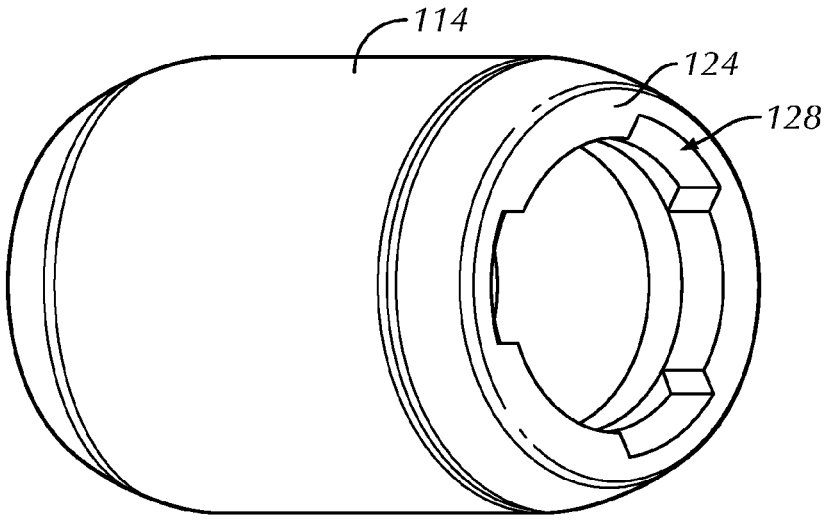

Sealing element 114 is disposed around the mandrel 101. The sealing element 114 seals an annulus between the bridge plug 100 and the casing wall (not shown). The sealing element 114 may be formed of any material known in the art, for example, elastomer or rubber. Two element end rings 124, 126 are disposed around the mandrel 101 and proximate either end of sealing element 114, radially inward of the sealing element 114, as shown in greater detail in FIGS. 3A and 3B. In one embodiment, sealing element 114 is bonded to an outer circumferential area of the element end rings 124, 126 by any method known in the art. Alternatively, the sealing element 114 is molded with the element end rings 124, 126. The element end rings 124, 126 may be solid rings or small tubular pieces formed from any material known in the art, for example, a plastic or composite material. The element end rings 124, 126 have at least one groove or opening 128 formed on an axial face and configured to receive a tab (not shown) formed on the end of an upper cone 110 and a lower cone 112, respectively, as discussed in greater detail below. One of ordinary skill in the art will appreciate that the number and location of the grooves 128 formed in the element end rings 124, 126 corresponds to the number and location of the tabs (not shown) formed on the upper and lower cones 110, 112.

Figure 4:
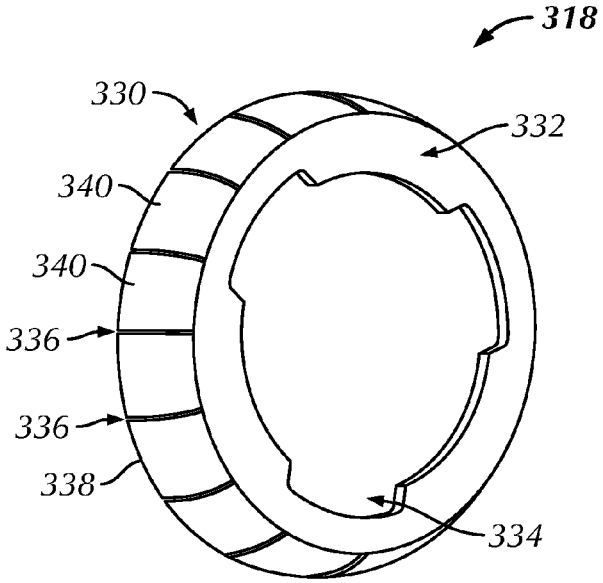
FIG. 4 is a perspective view of a barrier ring in accordance with embodiments disclosed herein.

Bridge plug 100 further includes two element barrier assemblies 116, each disposed adjacent an end of the sealing element 114 and configured to prevent or reduce extrusion of the sealing element 114 when the plug 100 is set. Each element barrier assembly 116 includes two barrier rings. As shown in FIG. 4, a barrier ring 318 in accordance with embodiments disclosed herein, is a cap-like component that has a cylindrical body 330 with a first face 332. First face 332 has a circular opening therein such that the barrier ring 318 is configured to slide over the mandrel 101 into position adjacent the sealing element 114 and the element end ring 124, 126. At least one slot 334 is formed in the first face 332 and configured to align with the groves 128 formed in the element end rings 124, 126 and to receive the tabs formed on the upper and lower cones 110, 112. One of ordinary skill in the art will appreciate that the number and location of the slots 334 formed in the first face 332 of the barrier ring 318 corresponds to the number and location of the grooves 128 formed in the element end rings 124, 126 and the number and location of the tabs (not shown) formed on the upper and lower cones 110, 112.

Barrier rings 318 may be formed from any material known in the art. In one embodiment, barrier rings 318 may be formed from an alloy material, for example, aluminum alloy. A plurality of slits 336 are disposed on the cylindrical body 330 of the barrier ring 318, each slit 336 extending from a second end 338 of the barrier ring 318 to a location behind the front face 332, thereby forming a plurality of flanges 340. When assembled, the two barrier rings 318 of the backup assembly (116 in FIG. 2B) are aligned such that the slits 336 of the first barrier ring are rotationally offset from the slits 336 of the second barrier ring. Thus, when the bridge plug (100 in FIG. 2B) is set, and the components of the bridge plug are compressed, the flanges 340 of the first and second barrier rings radially expand against the inner wall of the casing and create a circumferential barrier that prevents the sealing element (114 in FIG. 2B) from extruding.

Referring back to FIGS. 2A and 2B, bridge plug 100 further includes upper and lower cones 110, 112 disposed around the mandrel 101 and adjacent element barrier assemblies 116. The upper cone 110 may be held in place on the mandrel 101 by one or more shear screws (not shown). In some embodiments, an axial locking apparatus (not shown), for example lock rings, are disposed between the mandrel 101 and the upper cone 110, and between the mandrel 101 and the lower cone 112. Additionally, at least one rotational locking apparatus (not shown), for example keys, may be disposed between the mandrel 101 and the each of the upper cone 110 and the lower cone 112, thereby securing the mandrel 101 in place in the bridge plug 100 during the drilling or milling operation used to remove the bridge plug. An upper slip assembly 106 and a lower slip assembly 108 are disposed around the mandrel 101 and adjacent the upper and lower cones 110, 112, respectively. The bridge plug 100 further includes an upper gage ring 102 disposed around the mandrel 101 and adjacent the upper slip assembly 106, and a lower gage ring 104 disposed around the mandrel 101 and adjacent the lower slip assembly 108.

Figure 5A:
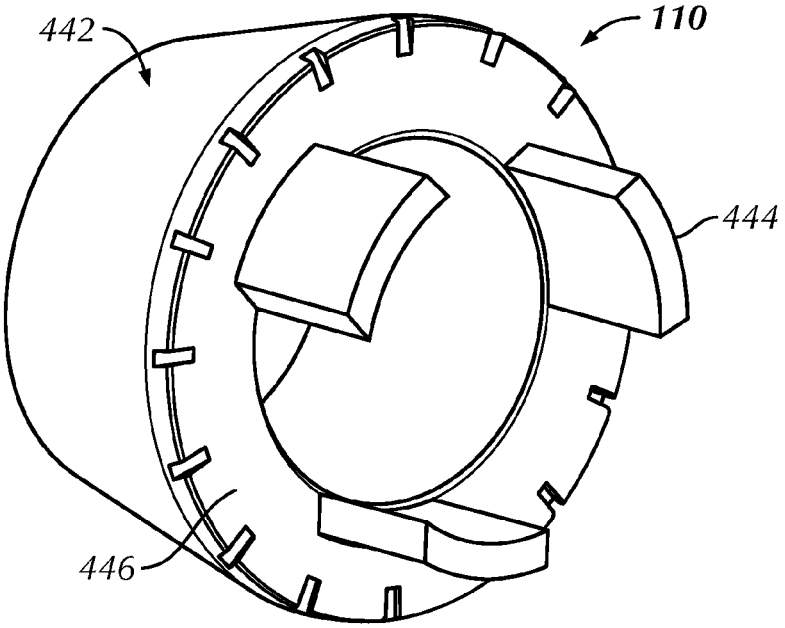
FIGS. 5A and 5B show perspective views of an upper cone and a lower cone, respectively, in accordance with embodiments disclosed herein.
Figure 5B:
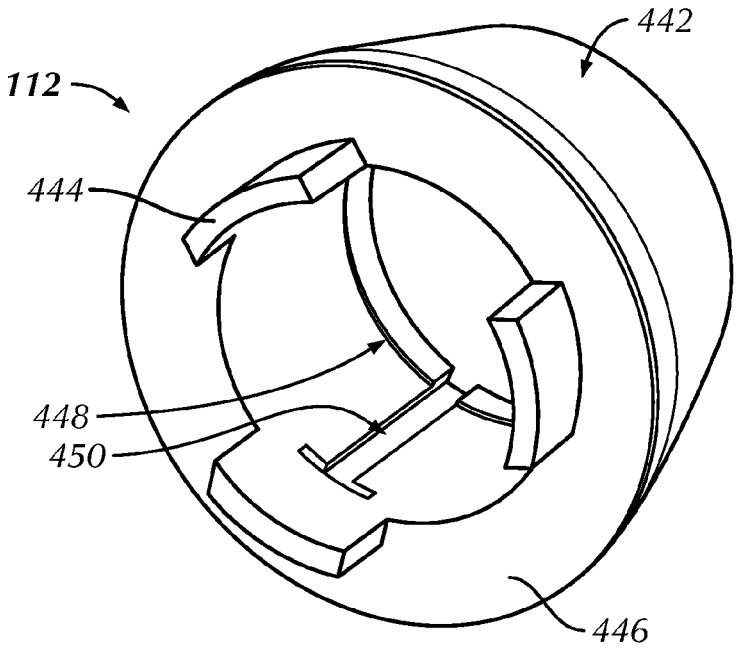

Referring now to FIGS. 5A and 5B, upper and lower cones 110, 112 have a sloped outer surface 442, such that when assembled on the mandrel, the outer diameter of the cone 110, 112 increases in an axial direction toward the sealing element (114 in FIG. 2B). Upper and lower cones 110, 112 include at least one tab 444 formed on a first face 446. The at least one tab 444 is configured to fit in a slot (334 in FIG. 4) formed in a first face (332) of the barrier rings (318) of the element barrier assembly (116 in FIG. 2B) and to engage the grooves (128 in FIG. 3B) in the element end rings (124, 126). One of ordinary skill in the art will appreciate that the number and location of tabs 444 corresponds to the number and location of the slots (334) formed in the first face (332) of the barrier ring (318) and the number and location of the grooves (128) formed in the element end rings (124, 126).

Briefly referring back to FIG. 2B, the engaged tabs (444 in FIG. 6) of the upper and lower cones 110, 112 rotationally lock the upper and lower cones 110, 112, with the upper and lower element barrier assemblies 116 and the element end rings 124, 126. Thus, during a drilling/milling process, i.e. drilling/milling the bridge plug out of the casing, the cones 110, 112, element barrier assemblies 116, and sealing element 114 are more easily and quickly drilled out, because the components do not spin relative to one another.

Referring back to FIGS. 5A and 5B, upper and lower cones 110, 112 are formed of a metal alloy, for example, aluminum alloy. In certain embodiments, upper and lower cones 110, 112 may be formed from a metal alloy and plated with another material. For example, in one embodiment, upper and lower cones 110, 112 may be copper plated. The present inventors have advantageously found that copper plated cones 110, 112 reduce the friction between components moving along the sloped surface 442 of the cones 110, 112, for example, the slip assemblies (106, 108 in FIG. 2B), thereby providing a more efficient and better-sealing bridge plug (100).

Figure 6:
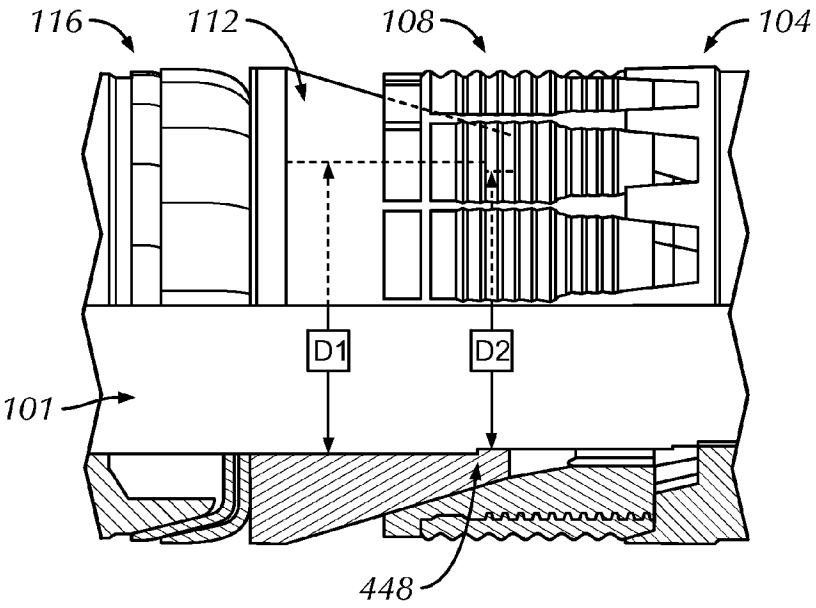
FIG. 6 shows a partial cross-sectional view of a bridge plug in accordance with embodiments disclosed herein.

As shown in FIG. 6, lower cone 112 has a first inside diameter D1 and a second inside diameter D2, such that a bearing shoulder 448 is formed between the first inside diameter D1 and the second inside diameter D2. The bearing shoulder 448 corresponds to a matching change in the outside diameter of the mandrel 101, such that during a drilling or milling process, the mandrel 101 stays in position within the bridge plug 100. In other words, the bearing shoulder 448 prevents the mandrel from falling out of the bridge plug 100 during a drilling or milling process.

Figure 7:
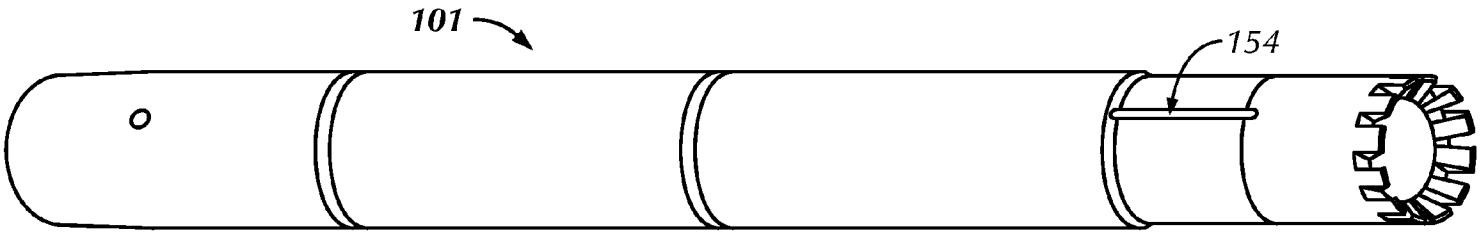
FIG. 7 is a perspective view of a mandrel of a bridge plug in accordance with embodiments disclosed herein.

Briefly referring back to FIG. 5B, lower cone 112 includes at least one axial slot 450 disposed on an inner surface. At least one key slot (154 in FIG. 7) is also formed on an outer diameter of the mandrel 101. When the lower cone 112 is disposed around the mandrel 101, the axial slot 450 and the key slot 154 are aligned and a rotational locking key (not shown) is inserted into the matching slots of the lower cone 112 and the mandrel 101. Thus, when inserted, the rotational locking key rotationally lock the lower cone 112 and the mandrel 101 during a drilling/milling process, thereby preventing the relative moment of one from another. One of ordinary skill in the art will appreciate that the key and key slots may be of any shape known in the art, for example, the key and corresponding key slot may have square cross-sections or any other shape cross-section. Further, one of ordinary skill in the art will appreciate that the rotational locking key may be formed of any material known in the art, for example, a metal alloy.

Figure 8:
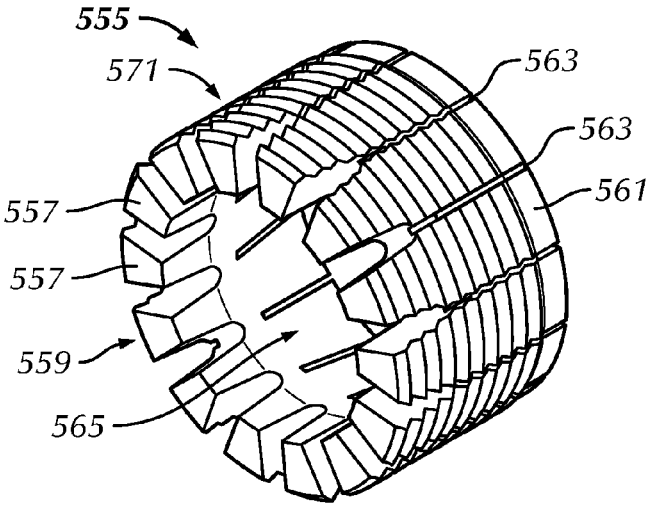
FIG. 8 is a perspective view of a slip assembly in accordance with embodiments disclosed herein.

Referring generally to FIGS. 2A and 2B, upper and lower slip assemblies 106, 108 are disposed adjacent upper and lower cones 110 and 112. Upper and lower gage rings 102 and 104 are disposed adjacent to and engage upper and lower slip assemblies 106, 108. Referring now to FIG. 8, in one embodiment, upper and lower slip assemblies include a frangible anchor device 555. Frangible anchor device 555 is a cylindrical component having a first end 559 and a second end 561. A plurality of castellations 557 is formed on the first end 559. The plurality of castellations 557 is configured to engage a corresponding plurality of castellations 662, 664 on upper and lower gage rings 102, 104, respectively (see FIGS. 9 and 10).

The second end 561 of the frangible anchor device 555 has a conical inner surface 565 configured to engage the sloped outer surfaces 442 of the upper and lower cones 110, 112 (see FIGS. 5A and 5B). Further, at least two axial slots 563 are formed in the second end 561 that extend from the second end 561 to a location proximate the castellations 557 of the first end 559. The axial slots 563 are spaced circumferentially around the frangible anchor device 555 so as to control the desired break-up force of the frangible anchor device 555. A plurality of teeth 571, sharp threads, or other configurations known in the art are formed on an outer surface of frangible anchor device 555 and are configured to grip or bite into a casing wall. In one embodiment, frangible anchor device 555, including teeth, is formed of a single material, for example, cast iron.

Figure 11:
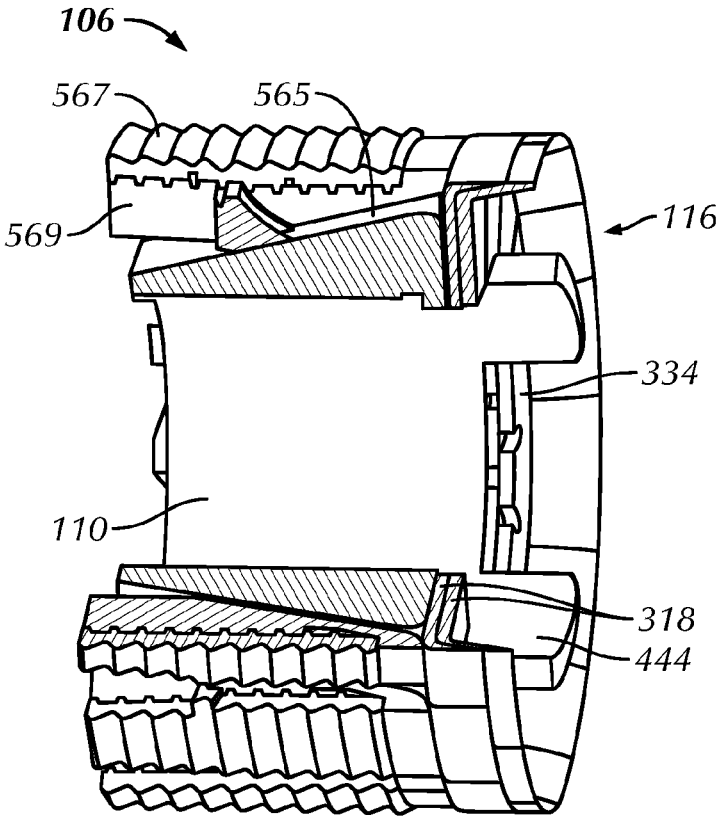
FIG. 11 is a partial cross-sectional view of an assembled slip assembly, upper cone, and element barrier assembly in accordance with embodiments disclosed herein.

In alternate embodiments, as shown in FIG. 11, slip assemblies 106, 108 include slips 567 disposed on an outer surface of a slip base 569. Slips 567 may be configured as teeth, sharp threads, or any other device know to one of ordinary skill in the art for gripping or biting into a casing wall. In certain embodiments, slip base 569 may be formed from a readily drillable material, while slips 567 are formed from a harder material. For example, in one embodiment, the slip base 569 is formed from a low yield cast aluminum and the slips 567 are formed from cast iron. One of ordinary skill in the art will appreciate that other materials may be used and that in certain embodiments the slip base 569 and the slips 567 may be formed from the same material without departing from the scope of embodiments disclosed herein.

FIG. 11 shows a partial perspective view of an assembly of the upper slip assembly 106, upper cone 110, and element barrier assembly 116. As shown, the conical inner surface 565 of slip base 569 is disposed adjacent the sloped surface 442 of the upper cone 110. Slips 567 are disposed on an outer surface of the slip base 569. Tabs 444 formed on a lower end of upper cone 110 are inserted through slots 334 in each of the two barrier rings 318 that form element barrier assembly 116. As shown, the slip assembly 106 may provide additional support for the sealing element (114 in FIG. 2), thereby limiting extrusion of the sealing element.

Figure 9:
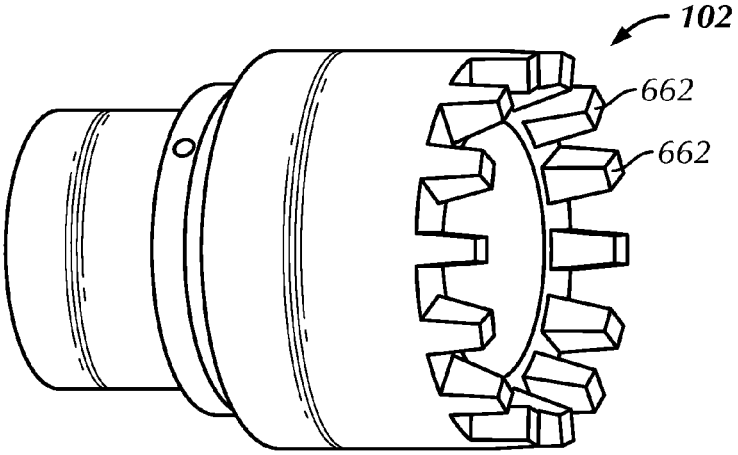
FIG. 9 is a perspective view of an upper gage ring in accordance with embodiments disclosed herein.

Referring now to FIG. 9, the upper gage ring 102 includes a plurality of castellations 662 on a lower end. As discussed above, the plurality of castellations 662 are configured to engage the plurality of castellations 557 of the upper and lower slip assemblies 106, 108, for example, the frangible anchor device 555 (see FIG. 8). The upper gage ring 102 further includes an internal thread (not shown) configured to thread with an external thread of an axial lock ring (125 in FIG. 2B) disposed around the mandrel (101 in FIG. 2).

Referring generally to FIG. 2B, the axial lock ring 125 is a cylindrical component that has an axial cut or slit along its length, an external thread, and an internal thread. As discussed above, the external thread engages the internal thread (not shown) of the upper gage ring 102. The internal thread of the axial lock ring 125 engages an external thread of the mandrel 101. When assembled, the upper gage ring 102 houses the axial lock ring.

Figure 10:
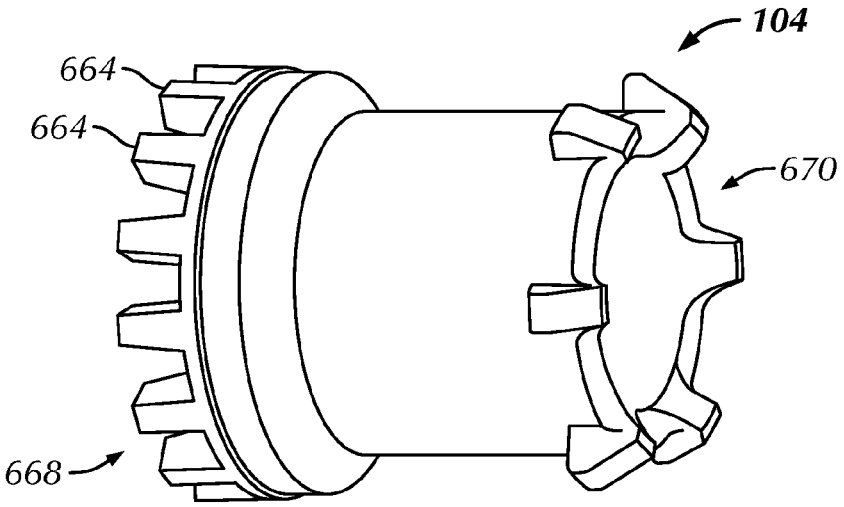
FIG. 10 is a perspective view of a lower gage ring in accordance with embodiments disclosed herein.

Referring now to FIG. 10, the lower gage ring 104 includes a plurality of castellations 664 on an upper end 668. As discussed above, the plurality of castellations 664 are configured to engage the plurality of castellations 557 of the upper and lower slip assemblies 106, 108, for example, frangible anchor device 555 (see FIG. 8). A box thread (not shown) is formed in a lower end 670 of the lower gage ring 104 and configured to engage a pin thread on an upper end of a second mandrel when using multiple plugs. In one embodiment, the box thread may be a taper thread. A box thread (not shown) is also formed in the upper end 668 of the lower gage ring 104 and configured to engage a pin thread on the lower end B of the mandrel 101 (see FIG. 2B). During a drilling/milling process, the lower gage ring 104 will be released and fall down the well, landing on a top of a lower plug. Due to the turning of the bit, the lower gage ring 104 will rotate as it falls and make up or threadedly engage the mandrel of the lower plug.

Referring generally to FIGS. 2-11, after the drillable bridge plug 100 is disposed in the well in its desired location, the bridge plug 100 is activated or set using an adapter kit. The plug 100 may be configured to be set by wireline, coil tubing, or conventional drill string. The adapter kit mechanically pulls on the mandrel 101 while simultaneously pushing on the upper gage ring 102, thereby moving the upper gage ring 102 and the mandrel 101 in opposite directions. The upper gage ring 102 pushes the axial lock ring, the upper slip assembly 106, the upper cone 110, and the element barrier assembly 116 toward an upper end of the sealing element 114, and the mandrel pulls the lower gage ring 104, the lower slip assembly 108, the lower cone 112, the rotational locking key, and the lower element barrier assembly 116 toward a lower end of the sealing element 114. As a result, the push and pull effect of upper gage ring 102 and the mandrel 101 compresses the sealing element 114.

Compression of the sealing element 114 expands the sealing element into contact with the inside wall of the casing, thereby shortening the overall length of the sealing element 114. As the bridge plug components are compressed, and the sealing element 114 expands, the adjacent element barrier assemblies 116 expand into engagement with the casing wall. As the push and pull forces increase, the rate of deformation of the sealing element 114 and the element barrier assemblies 116 decreases. Once the rate of deformation of the sealing element is negligible, the upper and lower cones 110, 112 cease to move towards the sealing element 114. As the activating forces reach a preset value, the castellations 662, 664 of the upper and lower cones 110, 112 engaged with the castellations 557 of the upper and lower slip assemblies 106, 108 breaks the slip assemblies 106, 108 into desired segments and simultaneously guide the segments radially outward until the slips 557 engage the casing wall. After the activating forces reach the preset value, the adapter kit is released from the bridge plug 100, and the plug is set.

Figure 12:
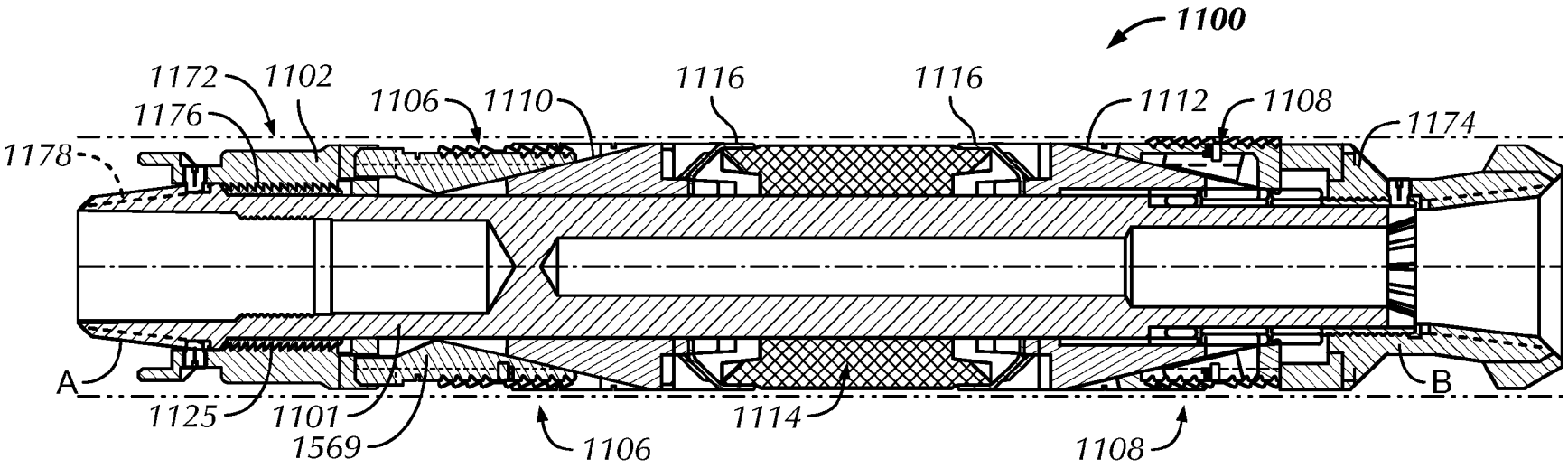
FIG. 12 is a cross-sectional view of a bridge plug in an unexpanded condition in accordance with embodiments disclosed herein.
Figure 13:
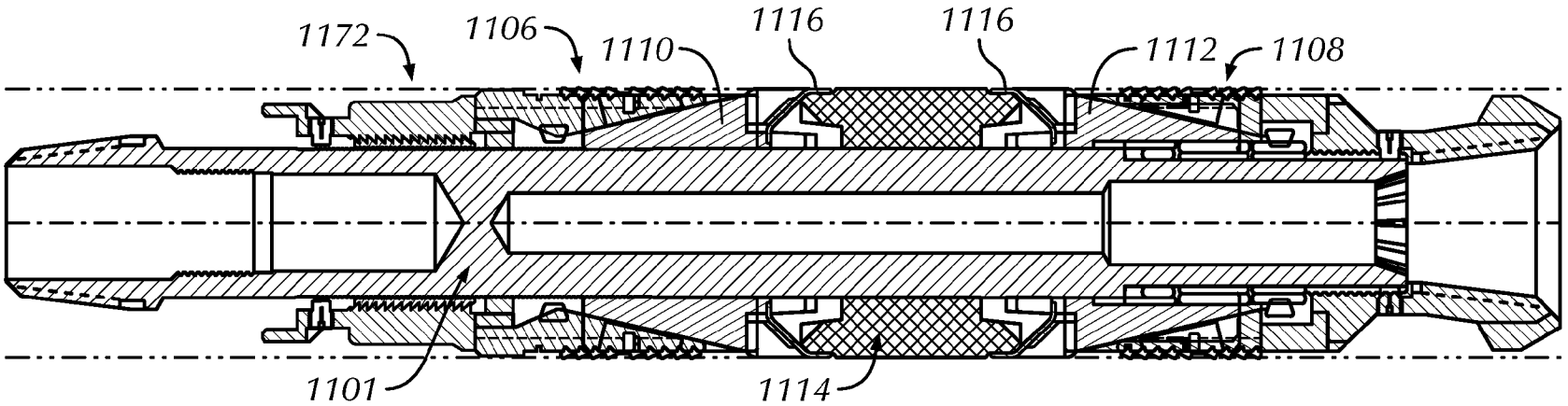
FIG. 13 is a cross-sectional view of the bridge plug of FIG. 12 in an expanded condition in accordance with embodiments disclosed herein.

Referring now to FIG. 12, a bridge plug 1100 in an unexpanded condition is shown in accordance with an embodiment of the present disclosure. FIG. 13 shows the bridge plug 1100 in an expanded condition. Bridge plug 1100 includes a mandrel 1101, a sealing element 1114, element barrier assemblies 1116 disposed adjacent the sealing element 1114, an upper and lower slip assembly 1106, 1108, upper and lower cones 1110, 1112, a locking device 1172, and a bottom sub 1174.

The mandrel 1101 may be formed as discussed above with reference to FIG. 2.

For example, mandrel 1101 may include a fixed bridge, as shown in FIG. 2B, or a movable bridge, as shown in FIG. 2C. A ratchet thread 1176 is disposed on an outer surface of an upper end A of mandrel 1101 and configured to engage locking device 1172. Upper end A of mandrel 1101 includes a threaded connection 1178 configured to engage a threaded connection in a lower end of a mandrel when multiple plugs are used. As discussed above, the mandrel 1101 may be formed from any material known in the art, for example an aluminum alloy.

Figure 14B:
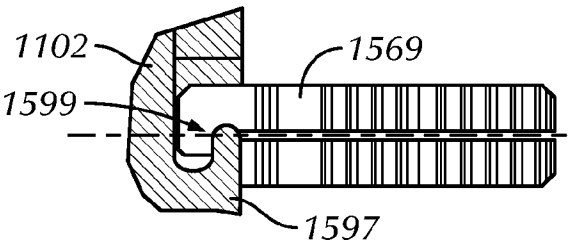
FIG. 14 is a partial cross-sectional view of a bridge plug in accordance with embodiments disclosed herein.
Figure 14A:
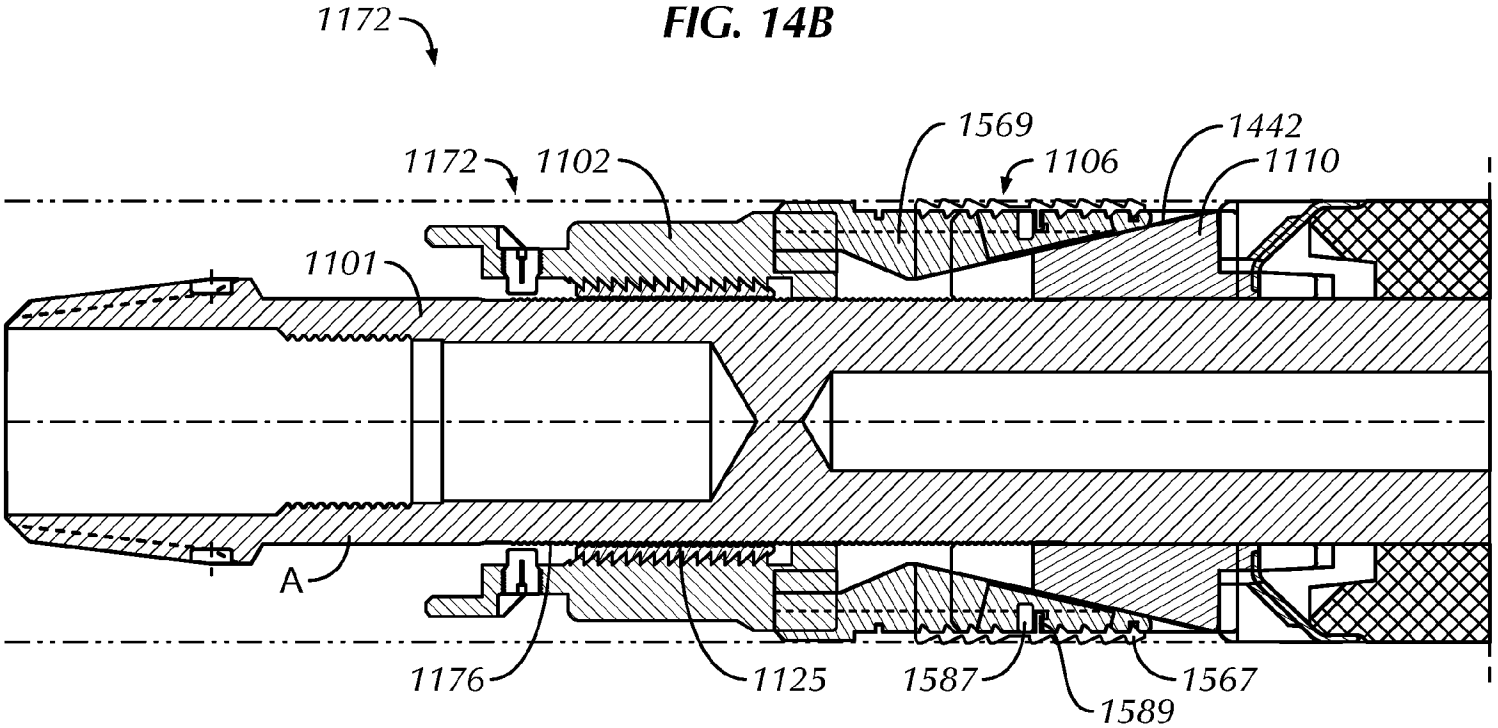

As shown in greater detail in FIG. 14, the locking device 1172 includes an upper gage ring, or lock ring housing, 1102, and an axial lock ring 1125. When a setting load or force is applied to the bridge plug 1100, the axial lock ring 1125 may move or ratchet over the ratchet thread 1176 disposed on an outer surface of the upper end A of mandrel 1101. Due to the configuration of the mating threads of the axial lock ring 1125 and the ratchet thread 1176, after the load is removed, the axial lock ring 1125 does not move or return upward. Thus, the locking device 1172 traps the energy stored in the sealing element 1114 from the setting load.

Further, when pressure is applied from below the bridge plug 1100, the mandrel 1101 may move slightly upward, thus causing the ratchet thread 1176 to ratchet through the axial lock ring 1125, thereby further pressurizing the sealing element 1114. Movement of the mandrel 1101 does not separate the locking device 1172 from the upper slip assembly 1106 due to an interlocking profile between the locking device 1172 and slip base 1569 (or frangible anchoring device, not independently illustrated) of the upper slip assembly 1106, described in greater detail below.

Figure 15B:
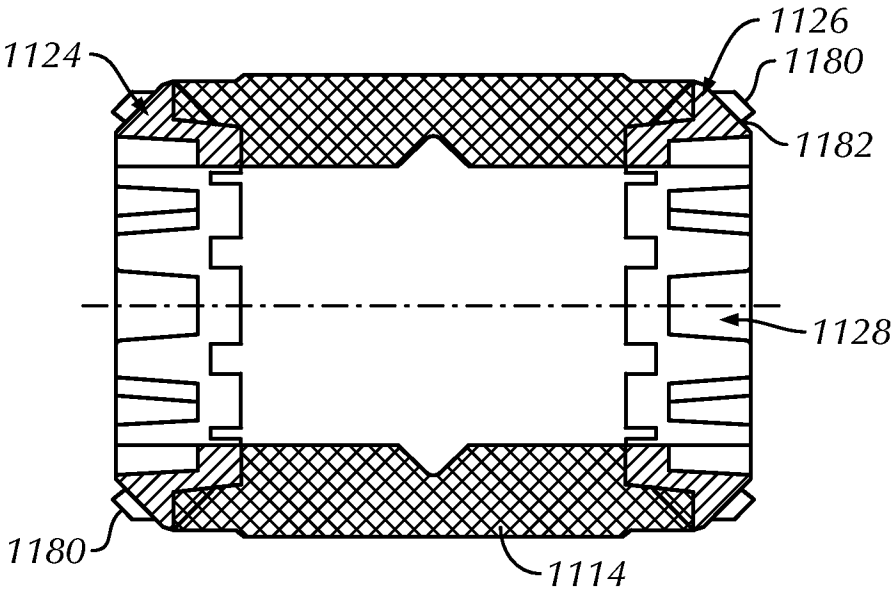
FIG. 15A and 15B are top and side views of a sealing element in accordance with embodiments disclosed herein.
Figure 15A:
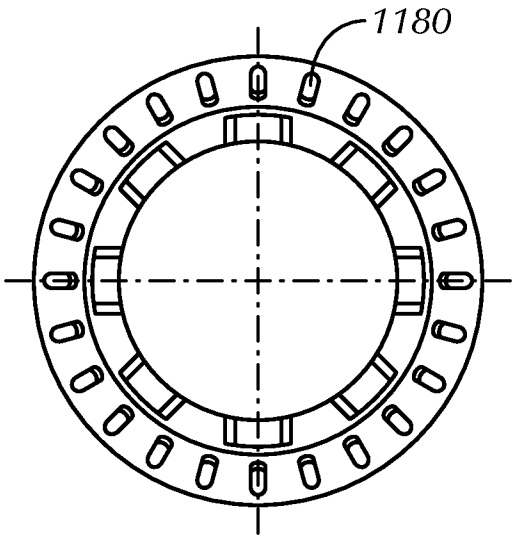

Referring now to FIGS. 12 and 15, sealing element 1114 is disposed around mandrel 1101. Two element end rings 1124, 1126 are disposed around the mandrel 1101 and proximate either end of the sealing element 1114, with at least a portion of each of the element end rings 1124, 1126 disposed radially inward of the sealing element 114. In one embodiment, sealing element 1114 is bonded to an outer circumferential area of the element end rings 1124, 1126 by any method know in the art. Alternatively, the sealing element 1114 is molded with the element end rings 1124, 1126. The element end rings 1124,

1126 formed from any material known in the art, for example, plastic, phenolic resin, or composite material.

The element end rings 1124, 1126 have at least one groove or opening 1128 formed on an axial face and configured to receive a tab (not shown) formed on the end of an upper cone 1110 and a lower cone 1112, respectively, as discussed above in reference to FIGS. 2-11. One of ordinary skill in the art will appreciate that the number and location of the grooves 1128 formed in the element end rings 1124, 1126 corresponds to the number and location of the tabs (not shown) formed on the upper and lower cones 1110, 1112.

As shown in FIG. 15, element end rings 1124, 1126 further include at least one protrusion 1180 disposed on an angled face 1182 proximate the outer circumferential edge of the element end rings 1124, 1126. The protrusions 1180 are configured to be inserted into corresponding openings (1184 in FIG. 17) in a barrier ring (1318 in FIG. 17), discussed in greater detail below. In certain embodiment, the protrusions 1180 may be bonded to or molded with the element end rings 1124, 1126.

Figures 16A, 16B, 16C:
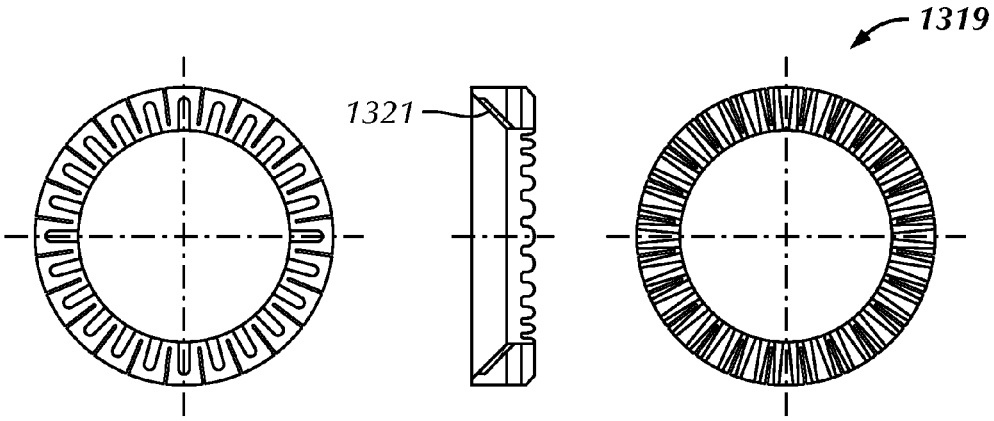
FIG. 16A, 16B, and 16C are top, side and bottom views of a frangible backup ring in accordance with embodiments disclosed herein.
Figures 17A, 17B:
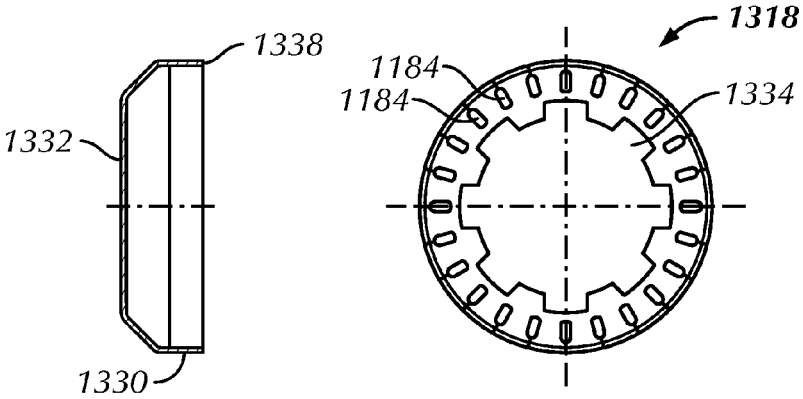
FIG. 17A and 17B are side and bottom views of a barrier ring in accordance with embodiments disclosed herein.

The element barrier assemblies 1116 are disposed adjacent the element end rings 1124, 1126 and sealing element 1114. Element barrier assembly 1116 includes a frangible backup ring 1319 and a barrier ring 1318, as shown in FIGS. 16 and 17, respectively. Frangible ring 1319 may be formed from any material known in the art, for example, plastic, phenolic resin, or composite material. Additionally, frangible ring 1319 may be formed with slits or cuts 1321 at predetermined locations, such that when the frangible ring 1319 breaks during setting of the bridge plug 1100, the frangible ring 1319 segments at predetermined locations, i.e., at the cuts 1321.

The barrier ring 1318 is a cap-like component that has a cylindrical body 1330 with a first face 1332. First face 1332 has a circular opening therein such that the barrier ring 1318 is configured to slide over the mandrel 1101 into a position adjacent the sealing element 1114 and the element end ring 1124, 1126. At least one slot 1334 is formed in the first face 1332 and configured to align with the grooves 1128 formed in the element end rings 1124, 1126 and configured to receive the tabs formed on the upper and lower cones 1110, 1112. One of ordinary skill in the art will appreciate that the number and location of the slots 1334 formed in the first face 1332 of the barrier ring 1318 corresponds to the number and location of grooves 1128 formed in the element end rings 1124, 1126 and the number and location of tabs (not shown) formed on the upper and lower cones 1110, 1112. Further, a plurality of openings 1184 are formed in the first face 1332 of the barrier ring 1318 and configured to receive the protrusions 1180 of the element end ring 1124, 1126. Thus, the protrusions 1180 rotationally lock the element barrier assembly 1116 with the sealing element 1114. One of ordinary skill in the art will appreciate that the number and location of the openings 1184 formed in the first face 1332 of the barrier ring 1318 corresponds to the number and location of protrusions formed in the element end rings 1124, 1126.

A plurality of slits (not shown) are disposed on the cylindrical body 1330 of the barrier ring 1318, each slit extending from a second end 1338 of the barrier ring 1318 to a location behind the front face 1332, thereby forming a plurality of flanges (not shown). When the setting load is applied to the bridge plug 1100, the frangible backup rings 1319 break into segments. The segments expand and contact the casing. The space between the segments in contact with the casing is substantially even, because the protrusions 1180 of the element end rings 1124, 1136 guide the segmented frangible backup rings 1319 into position. When the setting load is applied to the bridge plug 1100, the barrier rings 1318 expand and the flanges of the barrier rings 318 disposed on each end of the sealing element 1114 radially expand against the inner wall of the casing. The expanded flanges cover any space between the segments of the frangible backup rings 319, thereby creating a circumferential barrier that prevents the sealing element 1114 from extruding.

Referring back to FIGS. 12 and 14, upper and lower slip assemblies 1106, 1108 are configured to anchor the bridge plug 1100 to the casing and withstand substantially high loads as pressure is applied to the bridge plug 1100. Upper and lower slip assemblies 1106, 1108 include slip bases 1569, slips 1567, and slip retaining rings 1587. Upper and lower slip assemblies 1106, 1108 are disposed adjacent upper and lower cones 1110, 1112, respectively, such that conical inner surfaces of the slip base 1569 are configured to engage a sloped surface 1442 of the cones 1110, 1112.

Slip base 1569 of upper slip assembly 1106 includes a locking profile 1599 on an upper face of the slip base 1569. Locking profile 1599 is configured to engage the upper slip base 1569 with the upper gage ring 1102. Thus, upper gage ring 1102 includes a corresponding locking profile 1597 on a lower face. For example locking profiles 1599, 1597 may be interlocking L-shaped protrusions, as shown in View D of FIG. 14. As discussed above, these locking profiles 1597, 1599 secure the slip base 1569 to the upper gage ring 1102 during pressure differentials across the bridge plug 1100, thereby maintaining energization of the sealing element 1114. Further, L-shaped protrusions are less likely to break off than typical T-shaped connections and more likely to be efficiently drilled up during a drilling/milling process.

Slips 1567 may be configured as teeth, sharp threads, or any other device know to one of ordinary skill in the art for gripping or biting into a casing wall. In one embodiment, slips 1567 may include a locking profile that allows assembly of the slips 1567 to the slip base 1569 without additional fasteners or adhesives. The locking profile includes a protrusion portion 1589 disposed on an inner diameter of the slip 1567 and configured to be inserted into the slip base 1569, thereby securing the slip 1567 to the slip base 1569. Protrusion portion 1589 may be, for example, a hook shaped or L-shaped protrusion, to provide a secure attachment of the slip 1567 to the slip base 1569. One of ordinary skill in the art will appreciate that protrusions with different shapes and/or profiles may be used without departing from the scope of embodiments disclosed herein.

Slip base 1569 may be formed from a readily drillable material, while slips 1567 are formed from a harder material. For example, in one embodiment, the slip base 1569 is formed from a low yield cast aluminum and the slips 1567 are formed from cast iron. Alternatively, slip base 1569 may be formed from 6061-T6 aluminum alloy while slips 1567 are formed from induction heat treated ductile iron. One of ordinary skill in the art will appreciate that other materials may be used and that in certain embodiments the slip base and the slips may be formed from the same material without departing from the scope of embodiments disclosed herein.

Slip retaining rings 1587 are disposed around the slip base 1569 to secure the slip base 1569 to the bridge plug 1100 prior to setting. The slip retaining rings 1587 typically shear at approximately 16,000-18,000 lbs, thereby activating the slip assemblies 1106, 1108. After activation, the slip assemblies 1106, 1108 radially expand into contact with the casing wall. Once the slips 1567 contact the casing wall, a portion of the load applied to the sealing element 1114 is used to overcome the drag between the teeth of the slips 1567 and the casing wall.

While select embodiments of the present disclosure describe certain features of a bridge plug, one of ordinary skill in the art will appreciate that features discussed with respect to one embodiment may be used on alternative embodiments discussed herein. Further, one of ordinary skill in the art will appreciate that certain features described in the present disclosure may be applicable to both bridge plugs and frac plugs, and that use of the term bridge plug herein is not intended to limit the scope of embodiments to solely bridge plugs.

Figure 18A:
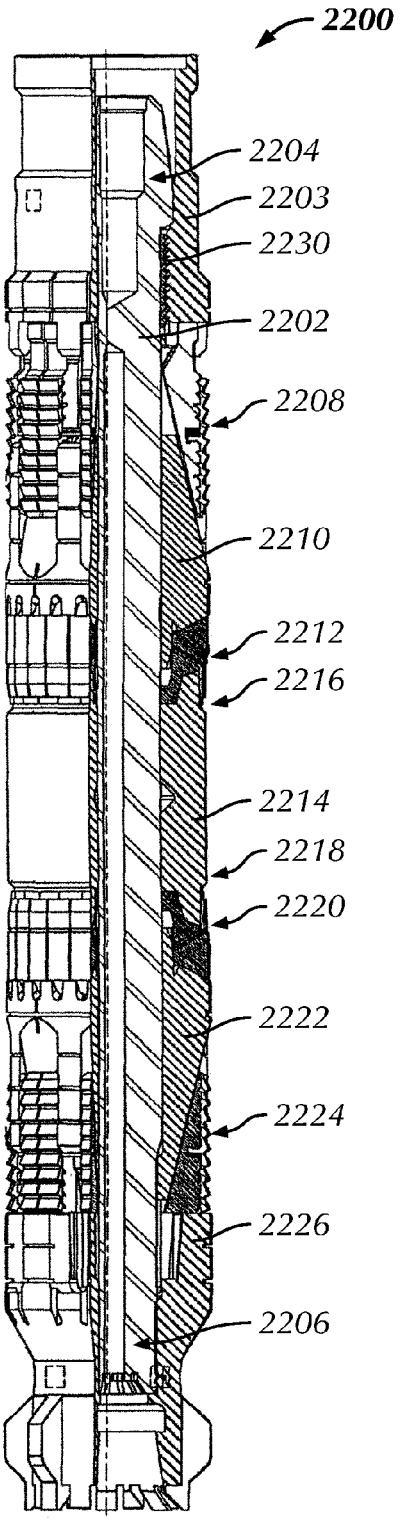
FIGS. 18A and 18B show a partial cross-sectional view of an unset downhole tool and a cross-sectional view of a set downhole tool, respectively, in accordance with embodiments disclosed herein.
Figure 18B:
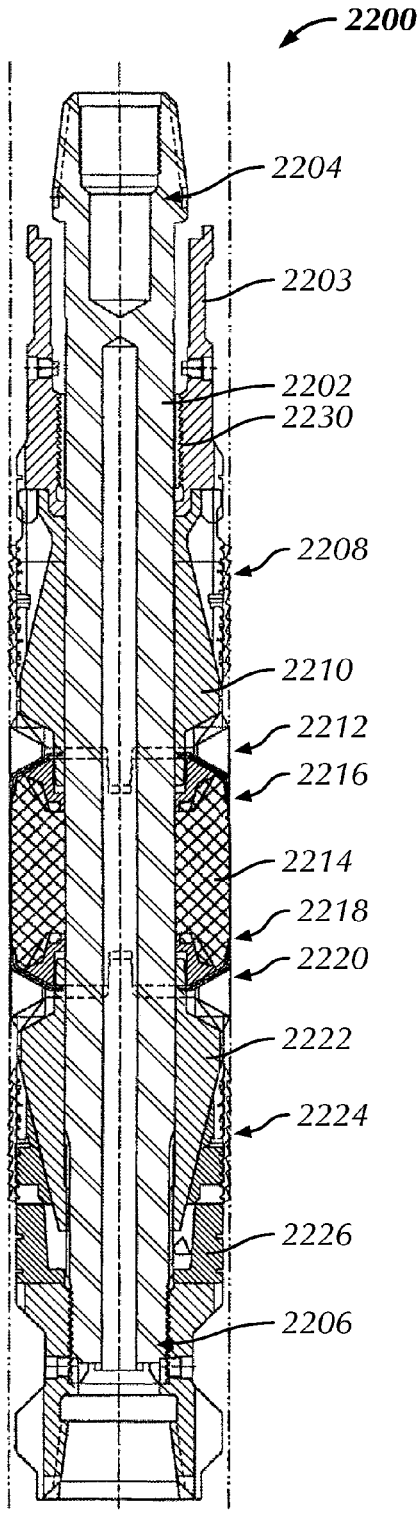

Referring to FIGS. 18A and 18B, a bridge plug 2200 in accordance with an embodiment of the present disclosure is shown in an unset position and a set position, respectively. In certain embodiments, bridge plug 2200 may be configured to withstand high pressure and high temperature environments. High pressure and high temperature environments may have negative effects on the effectiveness of sealing components. In particular, in drillable bridge plugs, high temperature environments may cause the material of sealing elements to degrade and weaken. When high pressure is applied, the degraded material of the sealing elements may begin to push through or extrude through any gaps that may exist in the support structure surrounding the sealing elements. As such, the effectiveness of the sealing element may be lost. Embodiments disclosed herein may provide a downhole tool such as, for example, a bridge plug or frac plug, capable of withstanding high temperature and high pressure environments.

Bridge plug 2200 may include a mandrel 2202 having an upper end 2204 and a lower end 2206. An upper cone 2210 may be disposed above an upper slip assembly 2208. Upper slip assembly 2208 including a slip pad 3004 and teeth 3002, as shown in detail in FIGS. 26A and 26B, may be disposed around an upper end of mandrel 2202 above upper cone 2210. Upper ring assembly 2212 may be disposed around mandrel 2202 above sealing element 2214 and may include an inner barrier ring 2500, an outer barrier ring 2600, and a back-up ring 2700, as shown in FIGS. 21A and 21B, FIGS. 22A and 22B, and FIGS. 23A, 23B, and 23C, respectively. Sealing element 2214 may include upper and lower end rings 2402, 2404 (shown in FIGS. 20A and 20B), on upper and lower ends 2216, 2218 of sealing element 2214, respectively. In certain embodiments, sealing element 2214 may be formed from an elastomeric material such as, for example, hydrogenated nitrile butadiene rubber (HNBR), nitrile, or fluoroelastomers such as Aflas®. Upper and lower end rings 2402, 2404 may be formed from a fiber impregnated phenolic plastic. In certain embodiments, upper and lower end rings 2402, 2404 may be positioned in a sealing element mold before the mold is filled with a material selected to form sealing element 2214. In such an embodiment, sealing element 2214 may be integrally formed with upper and lower end rings 2402, 2404 such that sealing element 2214 and upper and lower end rings 2402, 2404 make up a single component.

Lower ring assembly 2220 may be disposed below lower end ring 2404 of sealing element 2214 and may include inner barrier ring 2500, outer barrier ring 2600, and back-up ring 2700, shown in FIGS. 21A and 21B, FIGS. 22A and 22B, and FIGS. 23A, 23B, and 23C, as described above with respect to upper ring assembly 2212. Lower cone 2222 may be disposed around mandrel 2202 below lower ring assembly 2220, and lower slip assembly 2224 may be disposed below lower cone 2222. Lower slip assembly 2224 may include a slip pad 3004 and teeth 3002 as shown in detail in FIGS. 26A and 26B. A bottom sub 2226 may be coupled to the lower end 2206 of mandrel 2202.

To move bridge plug 2200 from an unset position into a set position, a setting tool may be used to apply an upward axial force to mandrel 2202 while simultaneously applying a downward axial force to components disposed around mandrel 2202. In certain embodiments, an upward axial force applied to mandrel 2202 may be transferred to bottom sub 2226, to lower slip assembly 2226, and to lower cone 2222 through various connections between the components. Additionally, a downward axial force applied to components disposed around mandrel 2202 may be transferred to upper slip assembly 2208 and to upper cone 2210. Both upward and downward axial forces may then be transferred from upper and lower cones 2210, 2222 to sealing element 2214 and upper and lower ring assemblies 2212, 2220, thereby causing deformation of lower ring assemblies 2212, 2220 and sealing element 2214. In certain embodiments, sealing element 2214 may be configured to deform in a desired area such that outward radial expansion occurs at a critical compressive pressure value. Outward radial deformation may cause sealing element 2214 to contact a wall of an outer casing 2228 and may form a seal.

Figure 19A:
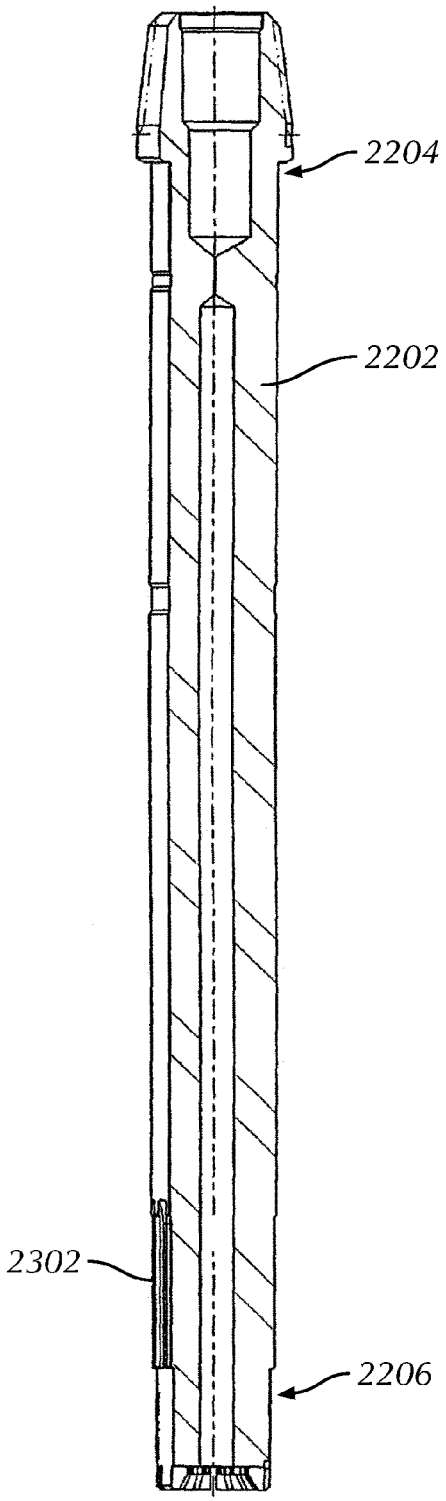
FIGS. 19A and 19B show cross-sectional views of a component of a downhole tool in accordance with embodiments disclosed herein.
Figure 19B:
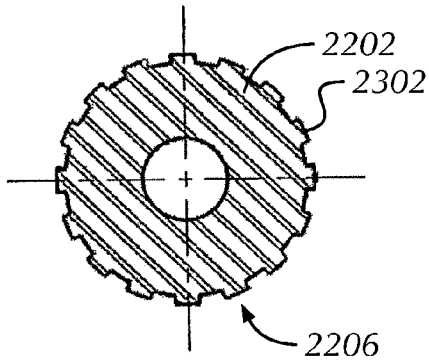

Looking to FIGS. 19A and 19B, cross-sectional views of mandrel 2202 are shown. Splines 2302 may be formed on lower end 2206 of mandrel 2202. As shown in FIG. 19B, splines 2302 are straight splines, but those having skill in the art will appreciate that other spline geometries may be used such as, for example, helical splines. Splines 2302 may be designed to engage corresponding splines disposed on an inner surface of lower cone 2222 (shown in FIGS. 18A, 18B). In select embodiments, engagement of splines 2302 with corresponding splines on lower cone 2222 may prevent relative rotation between mandrel 2202 and lower cone 2222.

Figure 20A:
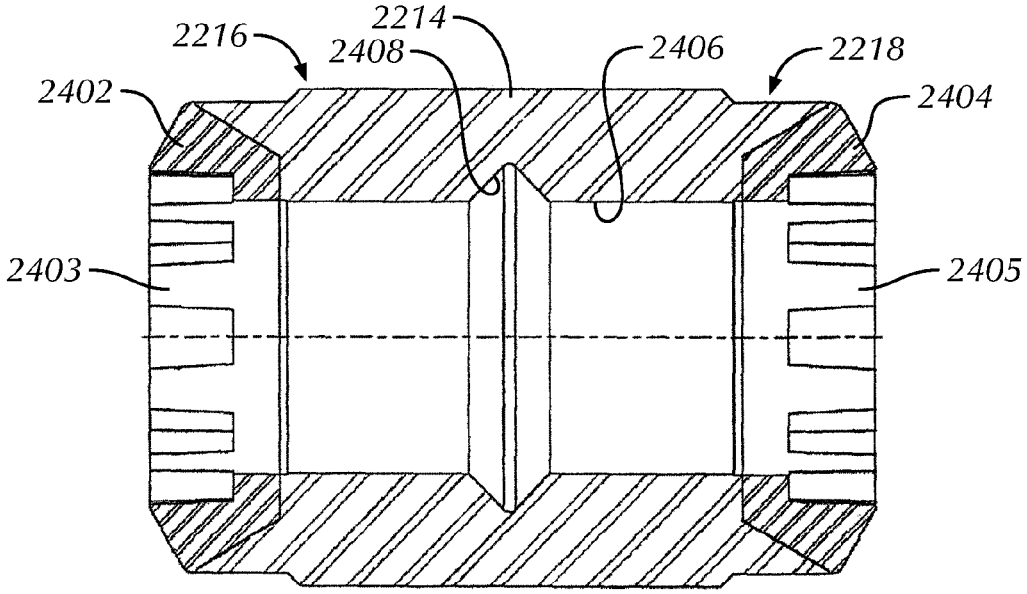
FIGS. 20A and 20B show cross-sectional and top views, respectively, of a component of a downhole tool in accordance with embodiments disclosed herein.
Figure 20B:
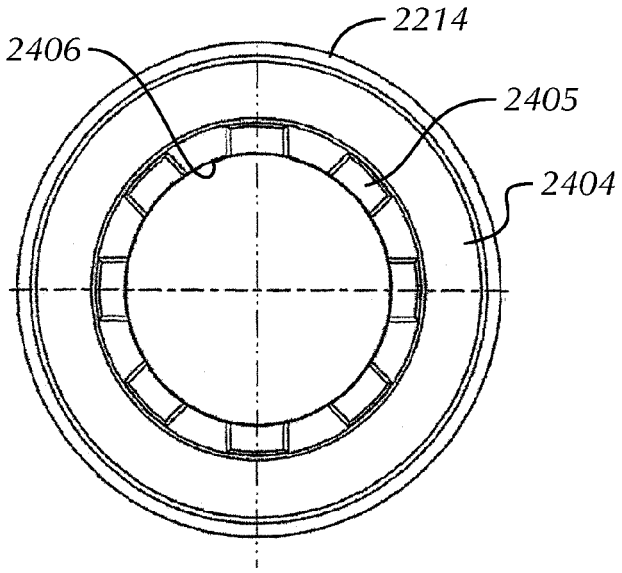

Referring to FIGS. 20A and 20B, cross-sectional views of sealing element 2214 are shown. Upper end ring 2402 may be disposed proximate upper end 2216 of sealing element 2214 and lower end ring 2404 may be disposed proximate lower end 2218 of sealing element 2214. In certain embodiments, upper and lower end rings 2402, 2404 may be shaped having upper and lower clutch fingers 2403, 2405 configured to align with corresponding fingers 2902, 2903 on upper and lower cones 2210, 2222, respectively, as will be discussed later on in reference to FIG. 24A. As discussed above, upper and lower end rings 2402, 2404 may be formed from a fiber impregnated phenolic plastic. Alternatively, upper and lower end rings 2402, 2404 may be formed from a molded thermoplastic. In certain embodiments, upper and lower end rings 2402, 2404 may be molded to sealing element 2214; however, those having skill in the art will appreciate that other means for connecting upper and lower end rings 2402, 2404 to sealing element 2214 may be used. As shown in FIG. 20A, sealing element 2214 is in an unset configuration. A reduced width portion 2408 may be disposed on an inner surface 2406 of sealing element 2214. During setting of the downhole tool, compression of sealing element 2214 may occur, thereby causing sealing element 2214 to buckle at reduced width portion 2418 and expand radially outward and into contact with an outer tubular or casing (not shown). In such an embodiment, the amount of compression exerted on sealing element 2214 may correspond to the radial force of sealing element 2214 against the casing.

Figure 21A:
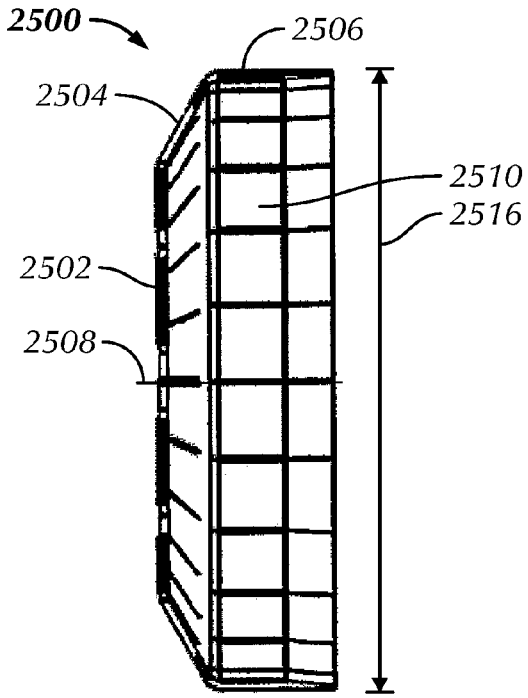
FIGS. 21A and 21B show side and top views, respectively, of a component of a downhole tool in accordance with embodiments disclosed herein.
Figure 21B:
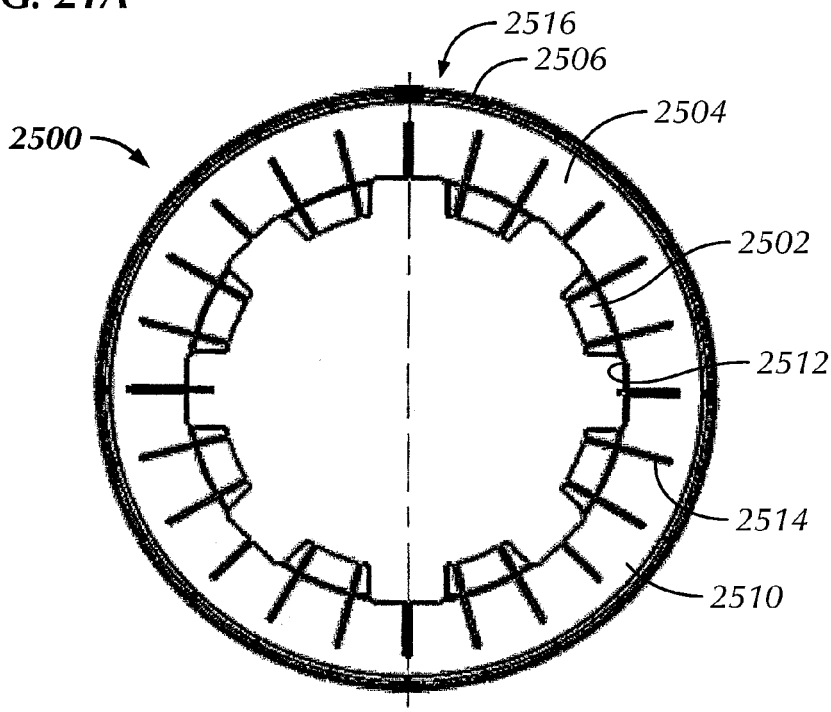

Referring now to FIGS. 21A and 21B, a cross-sectional view and a top view, respectively, of an inner barrier ring 2500 in accordance with embodiments disclosed herein are shown. Inner barrier ring 2500 may include a radial portion 2502 substantially perpendicular to a longitudinal axis 2508 of the downhole tool. Inner barrier ring 2500 having an outer diameter 2516 may further include an axial portion 2506 substantially parallel to longitudinal axis 2508 and an angled portion 2504 disposed between the radial and axial portions 2502, 2506. As shown, inner barrier ring 2500 may be divided into segments 2510 by slits 2514. Additionally, a plurality of cutouts 2512 may be disposed in radial portion 2502 of inner barrier ring 2500 and will be discussed below in detail.

Figure 22A:
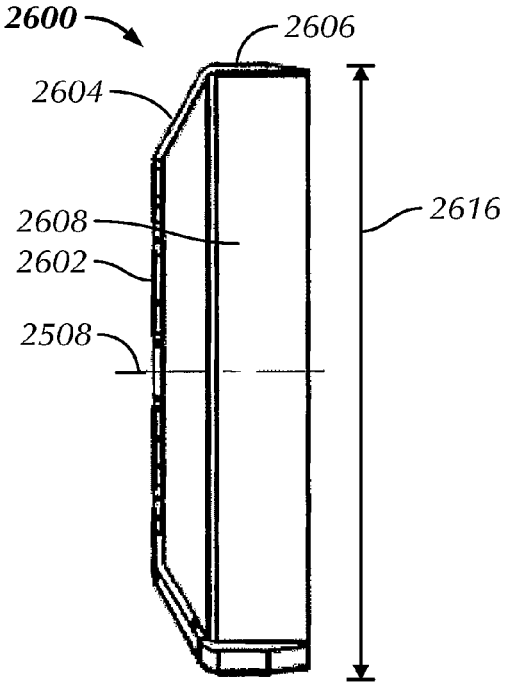
FIGS. 22A and 22B show cross-sectional and top views, respectively, of a component of a downhole tool in accordance with embodiments disclosed herein.
Figure 22B:
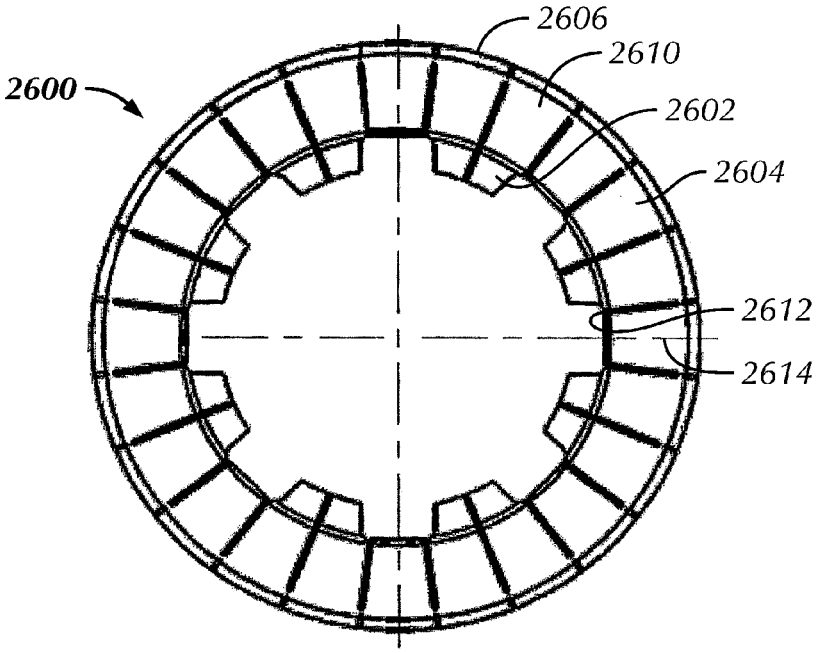

Looking to FIGS. 22A and 22B, an outer barrier ring 2600 in accordance with embodiments disclosed herein is shown in cross-sectional and top views, respectively. Outer barrier ring 2600 may include a radial portion 2602 substantially perpendicular to longitudinal axis 2508 of the downhole tool. Outer barrier ring 2600 may further include an axial portion 2606 substantially parallel to longitudinal axis 2508 and an angled portion 2604 disposed between the radial and axial portions 2602, 2606. A plurality of cutouts 2612 may be disposed in radial portion 2602 of outer barrier ring 2600. Additionally, outer barrier ring 2600 may include a lining 2608 on an inner surface of outer barrier ring 2600 as shown in FIG. 22A. In certain embodiments, lining 2608 may be formed from a ductile material such that radial expansion of lining 2608 may be allowed. Lining 2608 may be formed from an elastomeric material such as, for example, HNBR, nitrile, polytetrafluoroethylene (PTFE), or a flouroelastomer such as Aflas®. Outer barrier ring 2600 and lining 2608 may have an inner diameter 2616, wherein inner diameter 2616 is substantially the same size as outer diameter 2516 of inner barrier ring 2500. Alternatively, a small clearance may exist between inner diameter 2616 of outer barrier ring 2600 and outer diameter 2516 of inner barrier ring 2500.

Figure 24A:
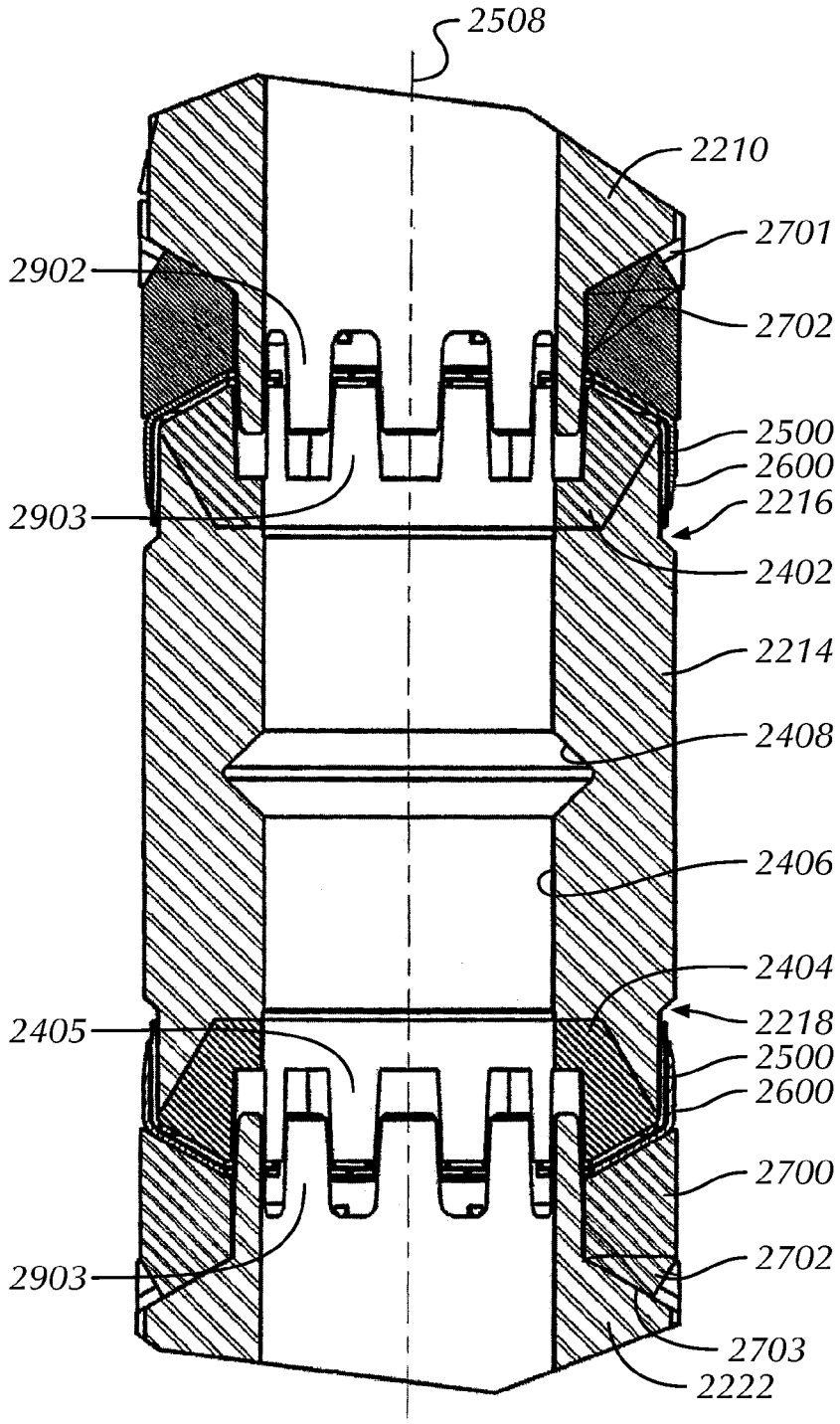
FIGS. 24A and 24B show cross-sectional views of an unset and a set component, respectively, of a downhole tool in accordance with embodiments disclosed herein.
Figure 24B:
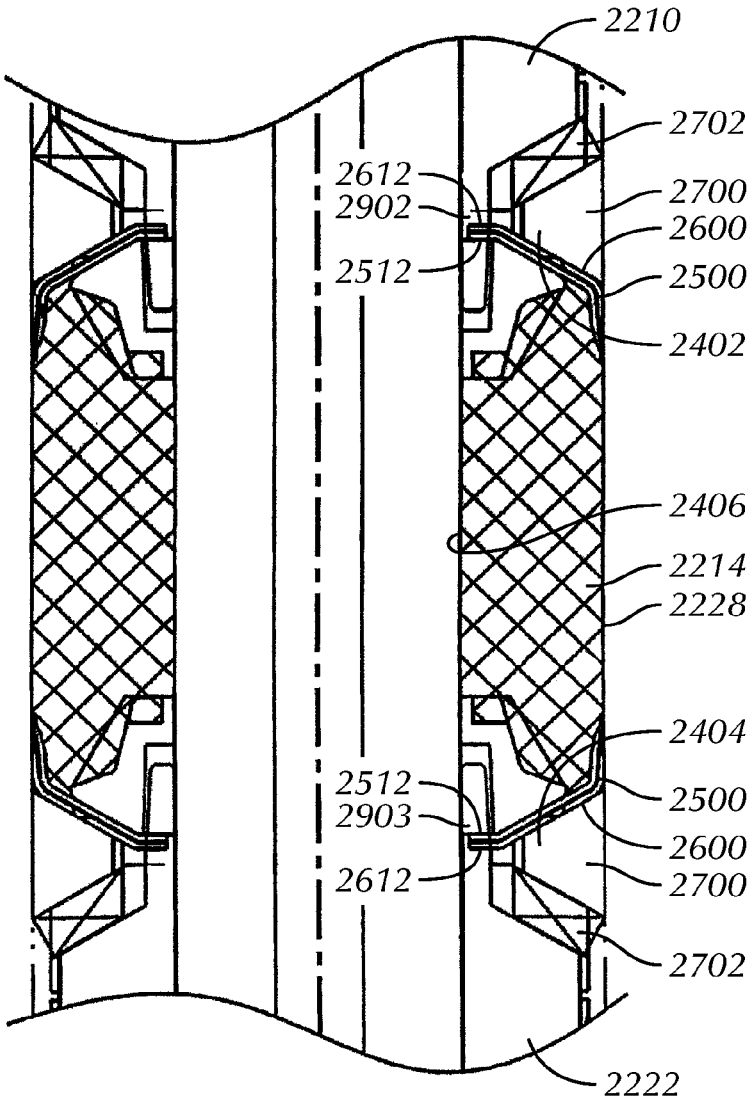
Figure 25B:
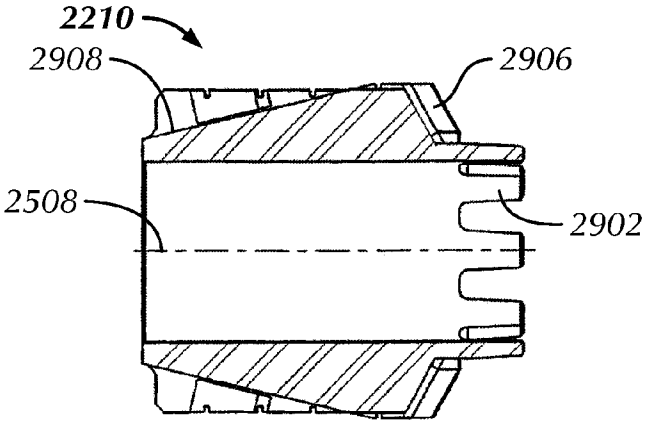
FIGS. 25A, 25B show top and cross-sectional views, respectively, of an upper component of a downhole tool in accordance with embodiments disclosed herein.
Figure 25D:
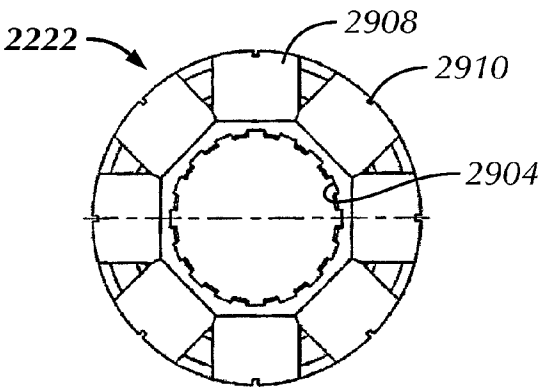
FIGS. 25C and 25D show cross-sectional and bottom views, respectively, of a lower component of a downhole tool in accordance with embodiments disclosed herein.
Figure 25A:
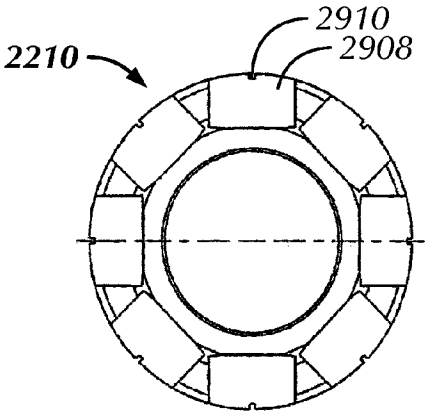
Figure 25C:
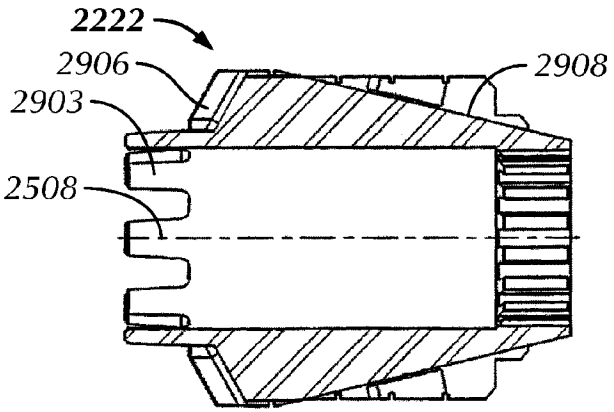

Referring to FIGS. 23A, 23B, and 23C, top, cross-section, and bottom views of a back-up ring 2700 in accordance with embodiments disclosed herein are shown. Slits 2712 may divide back-up ring 2700 into segments 2710. As shown in FIGS. 23B and 23C, each segment 2710 may include a projection 2702 configured to mesh with a corresponding profile 2701, 2703 on an upper and lower cone 2210, 2222, respectively, as shown in FIG. 24A. Back-up rings 2700 may be disposed adjacent outer barrier rings 2600 above and below sealing element 2214 as shown in FIGS. 24A and 24B. When bridge plug 2200 is set, back-up rings 2700 may be subjected to a compressive force. Back-up rings 2700 may be formed from a material such that, as a result of the compressive force, segments 2710 of back-up rings 2700 may separate and expand radially outwardly into contact with casing wall 2228 as shown in FIG. 24B. In certain embodiments, back-up rings 2700 may be formed from a phenolic material. The broken out segments 2710 of back-up ring 2700 may provide support against the extrusion of sealing element 2214 through gaps in inner and outer barrier rings 2500, 2600 by providing a stable surface against which inner and outer barrier rings 2500, 2600 may evenly deform. Additionally, the broken out segments 2710 of back-up ring 2700 may provide added support for inner and outer barrier rings 2500, 2600 and may provide an extra sealing surface against casing wall 2228 which may block the extrusion of sealing element 2214.

Referring to FIG. 24A, a cross-sectional view of an unset downhole tool in accordance with embodiments disclosed herein is shown. Inner barrier rings 2500 may be assembled adjacent upper and lower end rings 2402, 2404, which may be disposed adjacent upper and lower ends 2216, 2218 of sealing element 2214. Outer barrier rings 2600 may be positioned adjacent inner barrier rings 2500 such that inner barrier rings 2500 nest within outer barrier rings 2600. In certain embodiments, inner and outer barrier rings 2500, 2600 may be positioned such that axial portions 2506, 2606 extend to overlap upper and lower end rings 2402, 2404 on sealing element 2214. Looking to FIG. 24B, a cross-sectional view of a set downhole tool in accordance with embodiments disclosed herein is shown. During the radial expansion of sealing element 2214 that occurs while setting bridge plug 2200, axial portions 2506, 2606 and angled portions 2504, 2604 of inner and outer barrier rings 2500, 2600, respectively, may deform to expand radially due to their overlap with sealing element 2214. Slits 2514, 2614 forming segments 2510, 2610 on inner and outer barriers 2500, 2600 may allow inner and outer barriers 2500, 2600 to expand radially into contact with an outer tubular or casing wall 2228. In such a radially expanded configuration, inner and outer barrier rings 2500, 2600 may have gaps where slits 2514, 2614 have expanded. To prevent sealing element 2214 from extruding through gaps, inner and outer barrier rings 2500, 2600 may be offset such that a slit 2514 of inner barrier ring 2500 is aligned with a segment 2610 of outer barrier ring 2600 and, correspondingly, a slit 2614 of outer barrier ring 2600 is aligned with segment 2510 of inner barrier ring 2500. Additionally, lining 2608 disposed on outer barrier ring 2600 may contact inner barrier ring 2500 and extrude into any gaps between inner and outer barrier rings 2500, 2600, thereby filling gaps and providing added support against the extrusion of sealing element 2214 through gaps in inner and outer barrier rings 2500, 2600.

To maintain proper alignment of inner and outer barrier rings 2500, 2600 with respect to each other and with respect to sealing element 2214, upper and lower clutch fingers 2902, 2903 on upper and lower cones 2210, 2222 may engage cutouts 2512, 2612 disposed in inner and outer barrier rings 2500, 2600 such that relative movement between inner and outer barrier rings 2500, 2600 is prevented. Additionally, upper and lower clutch fingers 2902, 2903 of upper and lower cones 2210, 2222 may engage corresponding upper and lower clutch fingers 2403, 2405 of upper and lower end rings 2402, 2404 of sealing element 2214, thereby preventing relative rotational movement between inner and outer barrier rings 2500, 2600, sealing element 2214, and upper and lower cones 2210, 2222.

Referring to FIGS. 25A, 25B, 25C, and 25D, upper and lower cones in accordance with embodiments disclosed herein are shown. An upper cone 2210 is shown in top and cross-sectional views in FIGS. 25A and 25B, respectively, and a lower cone 2222 is shown in cross-sectional and bottom views in FIGS. 25C and 25D, respectively. As discussed above, upper cone 2210 and lower cone 2222 may include upper clutch fingers 2902 and lower clutch fingers 2903, respectively, configured to engage upper and lower clutch fingers 2403, 2405 of upper and lower end rings 2402, 2404, respectively, of sealing element 2214 through cutouts 2512, 2612 of inner and outer barrier rings 2500, 2600 (FIGS. 21A, 21B, 22A, and 22B). Upper and lower cones 2210, 2222 may further include a plurality of slip pad tracks 2908 disposed on an outer surface of the upper and lower cones 2210, 2222 configured to receive upper and lower slip assemblies 2208, 2224, respectively. Slip pad tracks 2908 may be disposed at an angle with respect to longitudinal axis 2508.

Figure 26A:
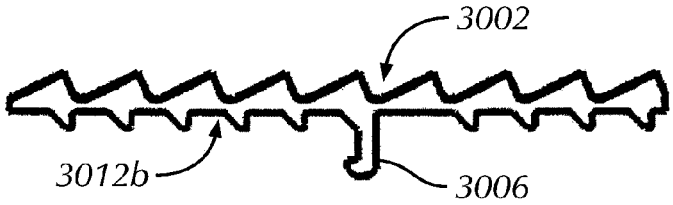
FIGS. 26A and 26B show partial cross-sectional views of a component of a downhole tool in accordance with embodiments disclosed herein.
Figure 26B:
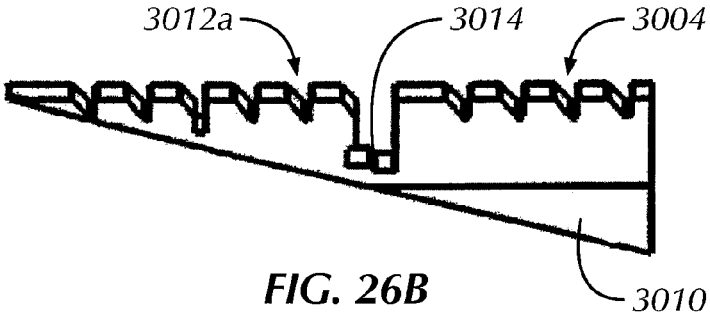

Referring now to FIGS. 26A and 26B, components of a slip assembly 2224 in accordance with embodiments disclosed herein is shown. Slip pad 3004 is shown having a tooth profile 3012*a* configured to engage a corresponding tooth profile 3012*b* disposed on a set of external teeth 3002. Additionally, a lock hook 3006 may extend downward from external teeth 3002 and may be configured to lock into a corresponding lock hook cutout 3014 disposed in slip pad 3004. In certain embodiments, the combination of engaging mating tooth profiles 3012*a*, 3012*b* and connecting mating lock hook 3006 with lock hook cutout 3014 may provide for the coupling of slip pad 3004 with external teeth 3002.

An assembly of slip pad 3004 and external teeth 3002 may be configured to sit in each slip pad track 2908. During setting of the downhole tool, slip pads 3004 may move within slip pad tracks 2908 to force external teeth 3002 into a casing wall (not shown). Slip pad tracks 2908 may help align slip pads 3004 and external teeth 3002 axially along the casing wall (not shown) such that engagement between slip pad teeth 3002 and the casing wall may be evenly distributed. Slip pad tracks 2908 may further include a slip pad guide 2910 configured to provide additional support in guiding a plurality of slip pads 3004 and external teeth 3002 along slip pad tracks 2908 during setting of the downhole tool. As shown in FIG. 26B, slip pad 3004 may include a guide tail 3010 configured to engage and move along slip pad guide 2910.

In certain embodiments, a slip ring (not shown) may be used to secure the assembly of slip pad 3004 and external teeth 3002 in place with respect to upper and lower cones 2210, 2222 until a critical pressure is reached during setting of the downhole tool. At the critical pressure, slip rings (not shown) may fail, thereby allowing movement of slip pad 3004 and external teeth 3002 along slip pad tracks 2908 and slip pad guides 2910 into engagement with a casing wall (not shown). Those having ordinary skill in the art will appreciate that slip rings may be designed to fail at any desired force or pressure value. For example, slip ring geometry, material, machining techniques, and other factors may be varied to produce a slip ring which will fail at a desired critical pressure. In certain embodiments, slip rings may be designed to fail at a force of approximately 16,000-18,000 lbs. Those having ordinary skill in the art will further appreciate that, prior to the failure of slip rings, all pressure applied during setting of the downhole tool goes toward deforming sealing element 2214 such that outward radial expansion and sealing engagement with a casing wall (not shown) occurs. Thus, a slip ring configured to withstand a higher pressure will allow a higher pressure to be applied to sealing element 2214, and conversely, a slip ring configured to withstand a low pressure will allow only a low pressure to be applied to sealing element 2214 before slip pads 3004 and external teeth 3002 are allowed to move and a grip casing wall (not shown). In certain embodiments, external teeth 3002 may be heat treated to obtain desired material properties using, for example, induction heat treating. In certain embodiments, induction heat treating external teeth 3002 may increase the strength of external teeth 3002 and may reduce the likelihood of crack origination and growth.

Figure 27:
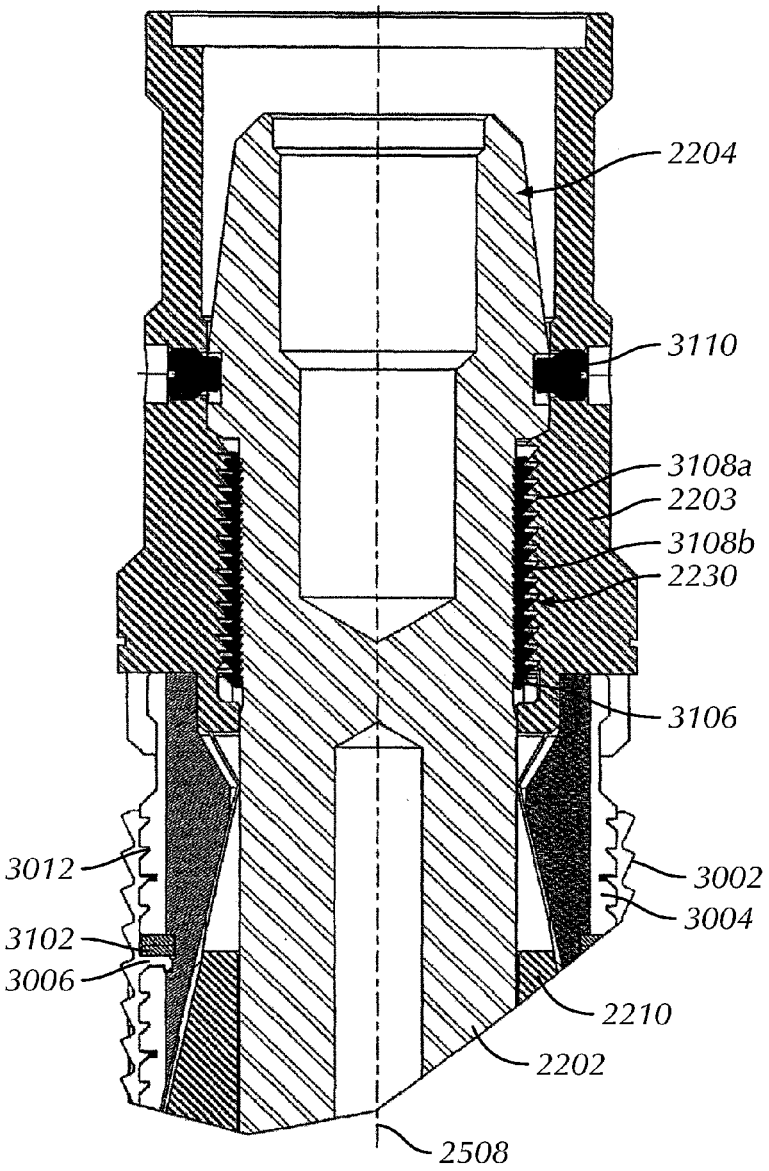
FIG. 27 shows a partial cross-sectional view of a downhole tool in accordance with embodiments disclosed herein.

Referring to FIG. 27, a detailed cross-sectional view of a bridge plug in accordance with the present disclosure is shown. A locking device 2230 is shown having a top sup 2203 with a ratchet profile 3108*a* disposed on an inner surface thereof. Top sub 2203 is shown disposed around upper end 2204 of mandrel 2202 and around a ratchet sleeve 3106. A ratchet profile 3108*b* may be disposed on an outer surface of ratchet sleeve 3106 and may be configured to correspond with ratchet profile 3108*a* on top sub 2203. Additionally, an inner surface of ratchet sleeve 3106 may include a threaded portion configured to threadedly engage corresponding threads disposed on an outer surface of mandrel 2202. Alternatively, those having ordinary skill in the art will appreciate that other means for connecting ratchet sleeve 3106 and mandrel 2202 may be used such as, for example, other mechanical connectors, adhesives, or welds.

As discussed previously, to set bridge plug 2200, a downward axial force may be applied to top sub 2203 while an upward axial force is simultaneously applied to mandrel 2202. As sealing element 2214 compresses and deforms outwardly, components disposed around mandrel 2202 are pushed closer together. Locking device 2230 may allow the amount of compression achieved by the setting tool during setting to be maintained even after the setting tool, or the setting force, is removed. Ratcheting profile 3108*a*, 3108*b* may be configured such that shoulders substantially perpendicular to longitudinal axis 2508 prevent top sub 2203 from moving axially upward with respect to mandrel 2203. Additionally, in certain embodiments, a shear screw 3110 may connect top sub 2203 with mandrel 2202 such that downward movement of top sub 2203 with respect to mandrel 2202 is prevented until an axial force sufficient to shear the shear screws 3110 is applied. Those having ordinary skill in the art will appreciate that the force required to shear the shear screws 3110 may depend on a number of factors such as, for example, geometry, material, and heat treatment of the shear screws 3110.

Figure 28:
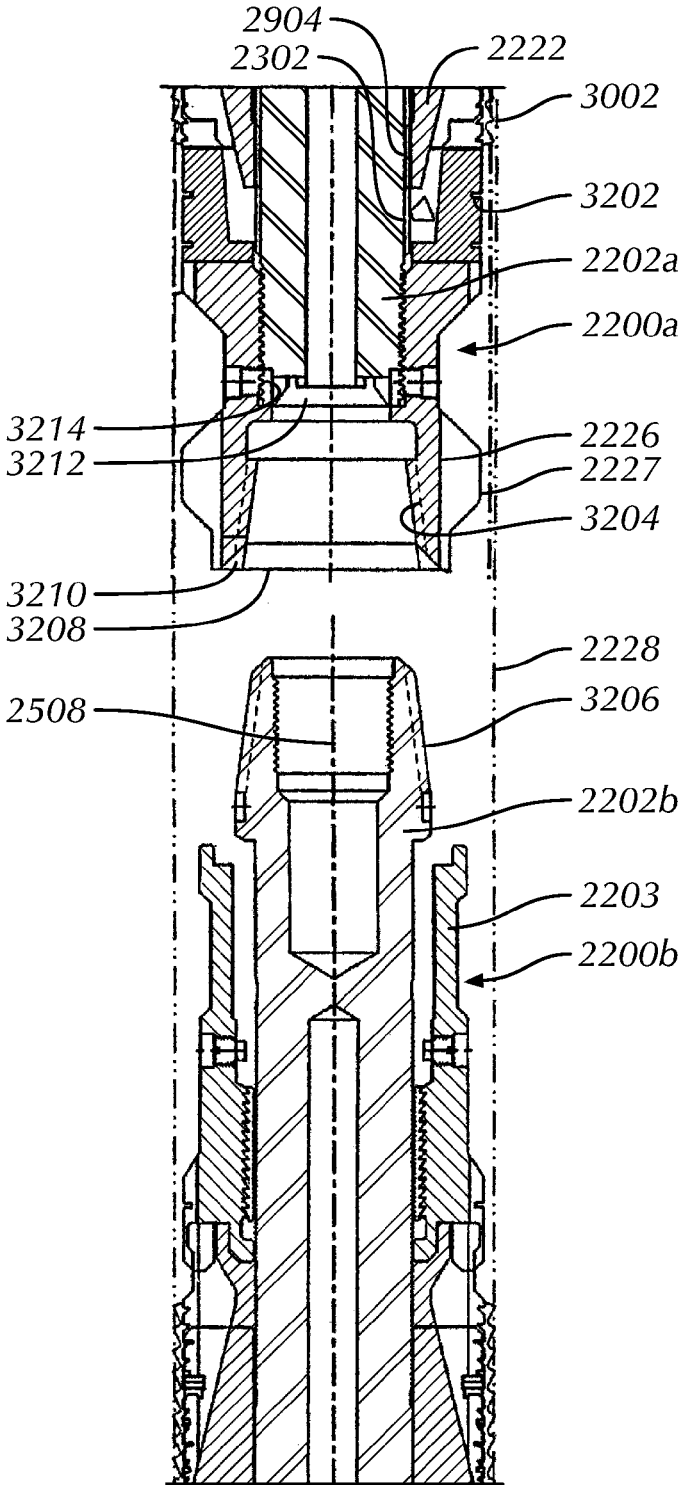
FIG. 28 shows a partial cross-sectional view of downhole tools in accordance with embodiments disclosed herein.

In certain situations, it may be desirable to remove a set bridge plug. Due to high costs of time, labor, and tooling associated with removing a bridge plug using a downhole removal tool, it may be more economical to drill out or mill out the bridge plug, and the designs and materials of each component of the bridge plug may be chosen with this end in mind. Looking to FIG. 28, an upper bridge plug 2200*a* is shown disposed in a casing 2228 above a lower bridge plug 2200*b*. Splines 2302 on mandrel 2202*a* are shown in engagement with corresponding splines 2904 on lower cone 2222. The splines may prevent components of bridge plug 2200*a* from rotating during a drill out procedure, and thus, may increase efficiency of the procedure.

Upper bridge plug 2200*a* is shown having a bottom sub 2226 disposed below lower cone 2222 and including a plurality of stress grooves 3202 on an outer surface thereof. Stress grooves 3202 may act as stress concentrators to increase the speed of the drill out process by encouraging the material of bottom sub 2226 to break apart upon drilling. Additionally, a first set of notches 3214 may be cut on a bottom surface 3212 of mandrel 2202*a* so that when a certain location on the mandrel is reached with the drill out tool, the remaining material between notches 3214 may break apart. Similarly, notches 3210 may be disposed on a bottom surface 3208 of bottom sub 2226 to increase the speed and efficiency of drilling out bridge plug 2200*a*.

Once gripping components such as, for example, external teeth 3002 are drilled out, less support is present to hold bridge plug 2200*a* in place. In certain embodiments, a portion of bottom sub 2226 may break free of bridge plug 2200*a* during a drill out procedure. Bottom sub 2226 may include an internal tapered thread 3204 configured to engage an external tapered thread 3206 disposed on an upper end of mandrel 2202*b* of lower bridge plug 2200*b*. In certain embodiments, drill out of upper bridge plug 2200*a* may cause bottom sub 2226 to spin with the drill out tool. In such an embodiment, as bottom sub 2226 of upper bridge plug 2200*a* falls onto mandrel 2202*b* of lower bridge plug 2200*b*, bottom sub 2226 may be spinning. In certain embodiments, internal tapered threads 3204 of bottom sub 2226 may engage external tapered threads 3206 of mandrel 2202*b* and the spinning motion of sub 2226 may provide sufficient torque to make up the threaded connection. This feature may allow the drill out tool to efficiently drill the remaining portion of bottom sub 2226 while it is threadedly engaged on mandrel 2202*a*. Additionally, a plurality of fins 2227 may be disposed on an outer surface of bottom sub 2226 and may extend radially outward. In such an embodiment, as bottom sub 2226 spins and falls downward, fins 2227 may remove debris from an inner wall 2228 of the casing by scraping against the built up debris.

Advantageously, embodiments disclosed herein may provide one or more barrier rings to prevent or reduce the amount of extrusion of the sealing element of a bridge plug when the bridge plug is set. Further, anchoring devices in accordance with embodiments of the present disclosure may provide a more even stress distribution on a cone and/or the casing wall.

Further, embodiments disclosed herein may advantageously provide a bridge plug that provides more efficient and quicker drilling/milling processes. Because components of the a bridge plug in accordance with the present disclosure are rotationally locked with one another, spinning of the components during drilling/milling processes is eliminated, thereby resulting in faster drilling/milling times.

Still further, a bearing shoulder provided in a lower cone of a bridge plug in accordance with the present disclosure allows a mandrel to stay engaged for a longer amount of time during a drilling/milling process than a conventional bridge plug. The bearing shoulder may allow for retention of the mandrel until the bearing shoulder is drilled up. Thus, the portion of the plug that remains in the well after the drilling/milling process is reduced.

Advantageously, embodiments disclosed herein may provide for a bridge plug capable of withstanding a high temperature and high pressure environment. In select embodiments, a bridge plug in accordance with the present disclosure may be rated to withstand pressures up to approximately 15,000 pounds per square inch (psi) and temperatures up to approximately 400 degrees Fahrenheit. Embodiments disclosed herein may further provide increased gripping of a bridge plug to a casing wall. Additionally, embodiments disclosed herein may provide for increased speed and efficiency during a drill out procedure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drillable bridge plug comprising:

a mandrel having an upper end and a lower end, wherein the lower end comprises external splines disposed on an outer surface of the mandrel;

a sealing element disposed around the mandrel;

an upper cone disposed around the mandrel proximate an upper end of the sealing element;

a lower cone disposed around the mandrel proximate the lower end of the sealing element, wherein an inner surface of the lower cone comprises internal splines configured to engage the external splines;

an upper slip assembly disposed around the mandrel adjacent a sloped surface of the upper cone;

a lower slip assembly disposed around the mandrel adjacent a sloped surface of the lower cone;

an upper ring assembly comprising a first upper segmented barrier ring, a second upper segmented barrier ring, and an upper back-up ring disposed proximate the upper end of the sealing element and positioned between the upper end of the sealing element and the upper cone, wherein a plurality of segments disposed in the first upper segmented barrier ring are radially offset with respect to a plurality of segments disposed in the second upper segmented barrier ring;

a lower ring assembly comprising a first lower segmented barrier ring, a second lower segmented barrier ring, and a lower back-up ring disposed proximate the lower end of the sealing element and positioned between the lower end of the sealing element and the lower cone, wherein a plurality of segments disposed in the first lower segmented barrier ring are radially offset with respect to a plurality of segments disposed in the second lower segmented barrier ring; and a bottom sub.

2. The tool of claim 1, wherein at least one of the segmented barrier rings comprises a lining.

3. The tool of claim 2, wherein the lining is formed from at least one of a group of materials consisting of a hydrogenated nitrile butadiene rubber (HNBR), a nitrile, and a fluoroelastomer.

4. The tool of claim 1, further comprising an upper element end ring disposed on the upper end of the sealing element and a lower element end ring disposed on the lower end of the sealing element.

5. The tool of claim 4, wherein the external splines and the internal splines are straight splines.

6. The tool of claim 1, wherein at least a portion of an outer surface of the mandrel comprises a first ratchet profile.

7. The tool of claim 6, wherein the first ratchet profile is configured to engage a second ratchet profile disposed on an inner surface of a ratchet sleeve.

8. The tool of claim 1, wherein at least one of the upper slip assembly and the lower slip assembly comprises a set of teeth, wherein the set of teeth is induction heat treated.

9. The tool of claim 1, wherein the sealing element is formed from a composite material.

10. The tool of claim 9, wherein the composite material is a fiber-impregnated phenolic resin.

11. The tool of claim 1, wherein at least one of the upper back-up ring and the lower the back-up ring is formed from a phenolic material.

12. A drillable bridge plug comprising:

a mandrel having an upper end and a lower end, wherein the lower end comprises external splines disposed on an outer surface of the mandrel;

a sealing element disposed around the mandrel;

an upper cone disposed around the mandrel proximate an upper end of the sealing element;

a lower cone disposed around the mandrel proximate the lower end of the sealing element, wherein an inner surface of the lower cone comprises internal splines configured to engage the external splines;

an upper slip assembly disposed around the mandrel adjacent sloped surface of the upper cone;

a lower slip assembly disposed around the mandrel adjacent a sloped surface of the lower cone;

an upper ring assembly comprising a first upper segmented barrier ring, a second upper segmented barrier ring, and an upper back-up ring disposed proximate the upper end of the sealing element, wherein a plurality of segments disposed in the first upper segment barrier ring are radially offset with respect to a plurality of segments disposed in the second upper segmented barrier ring;

a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring; and a bottom sub, wherein an outer surface of the bottom sub comprises at least one groove configured to act as a stress concentrator.

13. A drillable bridge plug comprising:

a mandrel having an upper end and a lower end, wherein the lower end comprises external splines disposed on an outer surface of the mandrel;

a sealing element disposed around the mandrel;

an upper cone disposed around the mandrel proximate an upper end of the sealing element;

a lower cone disposed around the mandrel proximate the lower end of the sealing element, wherein an inner surface of the lower cone comprises internal splines configured to engage the external splines;

an upper slip assembly disposed around the mandrel adjacent sloped surface of the upper cone;

a lower slip assembly disposed around the mandrel adjacent a sloped surface of the lower cone;

an upper ring assembly comprising a first upper segmented barrier ring, a second upper segmented barrier ring, and an upper back-up ring disposed proximate the upper end of the sealing element, wherein a plurality of segments disposed in the first upper segment barrier ring are radially offset with respect to a plurality of segments disposed in the second upper segmented barrier ring;

a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring; and a bottom sub, wherein the bottom sub comprises internal tapered threads disposed on an inner surface of the bottom sub.

14. The tool of claim 13, wherein a bottom surface of at least one of the bottom sub and the mandrel comprises notches disposed below the internal tapered threads configured to allow break-up of the bottom sub during drill out or milling of the bottom sub.

15. The tool of claim 13, wherein the upper end of the mandrel comprises external tapered threads configured to engage the internal tapered threads disposed on the inner surface of the bottom sub.

16. A drillable bridge plug comprising:

a mandrel having an upper end and a lower end, wherein the lower end comprises external splines disposed on an outer surface of the mandrel;

a sealing element disposed around the mandrel;

an upper cone disposed around the mandrel proximate an upper end of the sealing element;

a lower cone disposed around the mandrel proximate the lower end of the sealing element, wherein an inner surface of the lower cone comprises internal splines configured to engage the external splines;

an upper slip assembly disposed around the mandrel adjacent a sloped surface of the upper cone;

a lower slip assembly disposed around the mandrel adjacent a sloped surface of the lower cone;

an upper ring assembly comprising a first upper segmented barrier ring, a second upper segmented barrier ring, and an upper back-up ring disposed proximate the upper end of the sealing element, wherein a plurality of segments disposed in the first upper segmented barrier ring are radially offset with respect to a plurality of segments disposed in the second upper segmented barrier ring;

a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring; and a bottom sub, wherein the bottom sub comprises radially outwardly extending fins.

17. A method of setting a drillable bridge plug comprising:

applying an upward axial force to a mandrel;

transferring the upward axial force to a lower cone and an upper cone;

compressing a sealing element between the upper cone and the lower cone;

radially expanding the sealing element into contact with a casing;

creating a seal between the sealing element and the casing;

deforming an upper ring assembly and a lower ring assembly radially outwardly into contact with the casing;

exceeding a predetermined pressure of an upper slip assembly and a lower slip assembly; and radially expanding the upper slip assembly and the lower slip assembly to engage the casing, wherein the seal is fluid-tight under pressure up to approximately 15,000 pounds per square inch and under temperatures up to approximately 400° Fahrenheit, wherein deforming the upper ring assembly and the lower ring assembly further comprises breaking apart and radially expanding a back-up ring against the casing.

18. The method of claim 17, further comprising the step of aligning a first barrier ring having a plurality of slits and a plurality of segments with a second barrier ring having a plurality of slits and a plurality of segments, such that the plurality of slits on the second segmented barrier ring contact the plurality of segments on the first segmented barrier ring.

19. The method of claim 17, further comprising locking the radially expanded upper slip assembly and lower slip assembly with a locking device such that compression of the sealing element is maintained.

20. The method of claim 17, further comprising engaging a set of internal splines disposed on an inner surface of the lower cone with a set of external splines disposed on an outer surface of a mandrel.

21. A method of removing a drillable bridge plug comprising:

milling through a top portion of a first drillable bridge plug, the top portion of the first drillable bridge plug comprising:

a first mandrel having an upper end and a lower end, wherein the lower end comprises external splines disposed on an outer surface of the mandrel;

a sealing element disposed around the mandrel;

an upper cone disposed around the mandrel proximate an upper end of the sealing element;

a lower cone disposed around the mandrel proximate the lower end of the sealing element, wherein an inner surface of the lower cone comprises internal splines configured to engage the external splines;

an upper slip assembly disposed around the mandrel adjacent a sloped surface of the upper cone;

a lower slip assembly disposed around the mandrel adjacent a sloped surface of the lower cone;

an upper ring assembly comprising a first upper segmented barrier ring, a second upper segmented barrier ring, and an upper back-up ring disposed proximate the upper end of the sealing element, wherein a plurality of segments disposed in the first upper segmented barrier ring are radially offset with respect to a plurality of segments disposed in the second upper segmented barrier ring;

a lower ring assembly comprising a first lower segmented barrier ring, a second lower segmented barrier ring, and a lower back-up ring disposed proximate the lower end of the sealing element, wherein a plurality of segments disposed in the first lower segmented barrier ring are radially offset with respect to a plurality of segments disposed in the second lower segmented barrier ring; and a bottom sub connected to the lower end of the first mandrel using a connector;

milling through the connector disposed between the lower sub and the lower end of the first mandrel;

releasing a lower portion of the lower sub such that the lower portion of the lower sub falls onto a top portion of a second drillable bridge plug, wherein the lower portion of the lower sub comprises an inner thread, and wherein the top portion of the second drillable bridge plug comprises an outer thread configured to engage the inner thread of the lower portion of the lower sub.

22. The method of claim 21, further comprising preventing relative rotation between the mandrel and the lower cone, wherein rotation is prevented by engaging the external splines disposed on the mandrel with the inner splines disposed on the lower cone.

23. The method of claim 21, wherein releasing the lower portion of the lower sub further comprises cleaning debris from a casing wall using a plurality of fins disposed on the lower portion of the lower sub.

24. The method of claim 21, further comprising the step of milling the lower portion of the lower sub while the lower portion of the lower sub is threadedly engaged with the top portion of the second drillable bridge plug.

* * * * *